US008763687B2

(12) United States Patent
Ingram et al.

(10) Patent No.: US 8,763,687 B2
(45) Date of Patent: Jul. 1, 2014

(54) WELLBORE ISOLATION TOOL USING SEALING ELEMENT HAVING SHAPE MEMORY POLYMER

(75) Inventors: Gary Ingram, Richmond, TX (US); Minh-Tuan Nguyen, Houston, TX (US); Paul Wilson, Aledo, TX (US); Chris Johnson, Houston, TX (US); Deborah L. Banta, Humble, TX (US); Jacob Bramwell, Houston, TX (US); Stone Fagley, Katy, TX (US); Varadaraju A. Gandikota, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 247 days.

(21) Appl. No.: 13/285,656

(22) Filed: Oct. 31, 2011

(65) Prior Publication Data

US 2012/0055667 A1 Mar. 8, 2012

Related U.S. Application Data

(63) Continuation of application No. PCT/US2010/033161, filed on Apr. 30, 2010.

(60) Provisional application No. 61/174,904, filed on May 1, 2009.

(51) Int. Cl.
*E21B 33/127* (2006.01)

(52) U.S. Cl.
USPC ..... 166/187

(58) Field of Classification Search
USPC ..... 166/387, 179, 180, 187
See application file for complete search history.

(56) References Cited

U.S. PATENT DOCUMENTS

| | | | | |
|---|---|---|---|---|
| 5,605,195 | A | 2/1997 | Eslinger et al. | |
| 6,203,020 | B1 | 3/2001 | Mireles, Jr. et al. | |
| 6,681,849 | B2 | 1/2004 | Goodson, Jr. | |
| 6,752,205 | B2 | 6/2004 | Kutac et al. | |
| 6,872,433 | B2 | 3/2005 | Seward et al. | |
| 6,896,063 | B2 | 5/2005 | Chang et al. | |
| 7,104,317 | B2 | 9/2006 | Richard et al. | |
| 7,735,567 | B2 * | 6/2010 | O'Mally et al. | 166/387 |
| 7,743,825 | B2 | 6/2010 | O'Malley et al. | |
| 2005/0202194 | A1 | 9/2005 | Browne et al. | |
| 2007/0240877 | A1 | 10/2007 | O'Malley et al. | |
| 2007/0240885 | A1 * | 10/2007 | O'Mally et al. | 166/387 |
| 2008/0087431 | A1 | 4/2008 | Willauer et al. | |

(Continued)

OTHER PUBLICATIONS

"Shape-Memory Effect," by Andreas Lendlein and Steffen Kelch, Agnew. Chem. Int. Ed. 2002, 41, 2034-2057 (c) Wiley-VCH Verlag GmbH, 69451 Weinheim, Germany, 2002 1433-7851/02/4112-2035, 24 pages.

(Continued)

*Primary Examiner* — William P Neuder
(74) *Attorney, Agent, or Firm* — Wong, Cabello, Lutsch, Rutherford & Brucculeri, LLP

(57) ABSTRACT

Anti-extrusion devices, packer elements, and inflatable packers include shape memory polymer (SMP) materials to enhance the operation of a packer, a bridge plug, or other downhole isolation tool. Seal system use seals of various material including SMP materials as booster for the seal produced. Tool for flow shut-off and sliding sleeve applications use SMP materials to open or close off flow through a tool.

33 Claims, 33 Drawing Sheets

(56) References Cited

U.S. PATENT DOCUMENTS

| | | | | |
|---|---|---|---|---|
| 2008/0264647 | A1 | 10/2008 | Li | |
| 2009/0242214 | A1 * | 10/2009 | Foster et al. | 166/387 |
| 2012/0305253 | A1 * | 12/2012 | O'Malley | 166/302 |

OTHER PUBLICATIONS

Materials Today, "Shape-memory polymers," by Marc Behl and Andreas Lendlein, Center for Biomaterial Development, Institute of Polymer Research, GKSS Research Center Goosthacht, Kantstr. 55, D-14513 Teltow, Germany, Apr. 2007, vol. 10, No. 4 ISSN:1369 7021 (C) Elsevier Ltd. 2007, 9 pages.

"Inflatable Retrievable Production Packer (IRPP)," Weatherford International, Ltd., obtained from www.weatherford.com, (c) 2006, brochure No. 2900.00, 2 pages.

"Inflatable Packers Catalog," Weatherford International, Ltd., obtained from www.weatherford.com, (c) 2008, brochure No. 612.01, 64 pages.

Office Action received in CA Application 2759401, dated Jan. 10, 2013, 2 pages.

Office Action received in CA Application 2759401, dated Jul. 19, 2013, 2 pages.

International Preliminary Report and Opinion received in corresponding PCT Application PCT/US2010/033161, dated Nov. 1, 2011, 8 pages.

"Discontinuous HD BULLDOG ACP Annulus Casing Packing," Weatherford International, Ltd., obtained from www.weatherford.com, brochure No. 6288.00, copyright 2009, 3 pages.

* cited by examiner

Fig. 22B
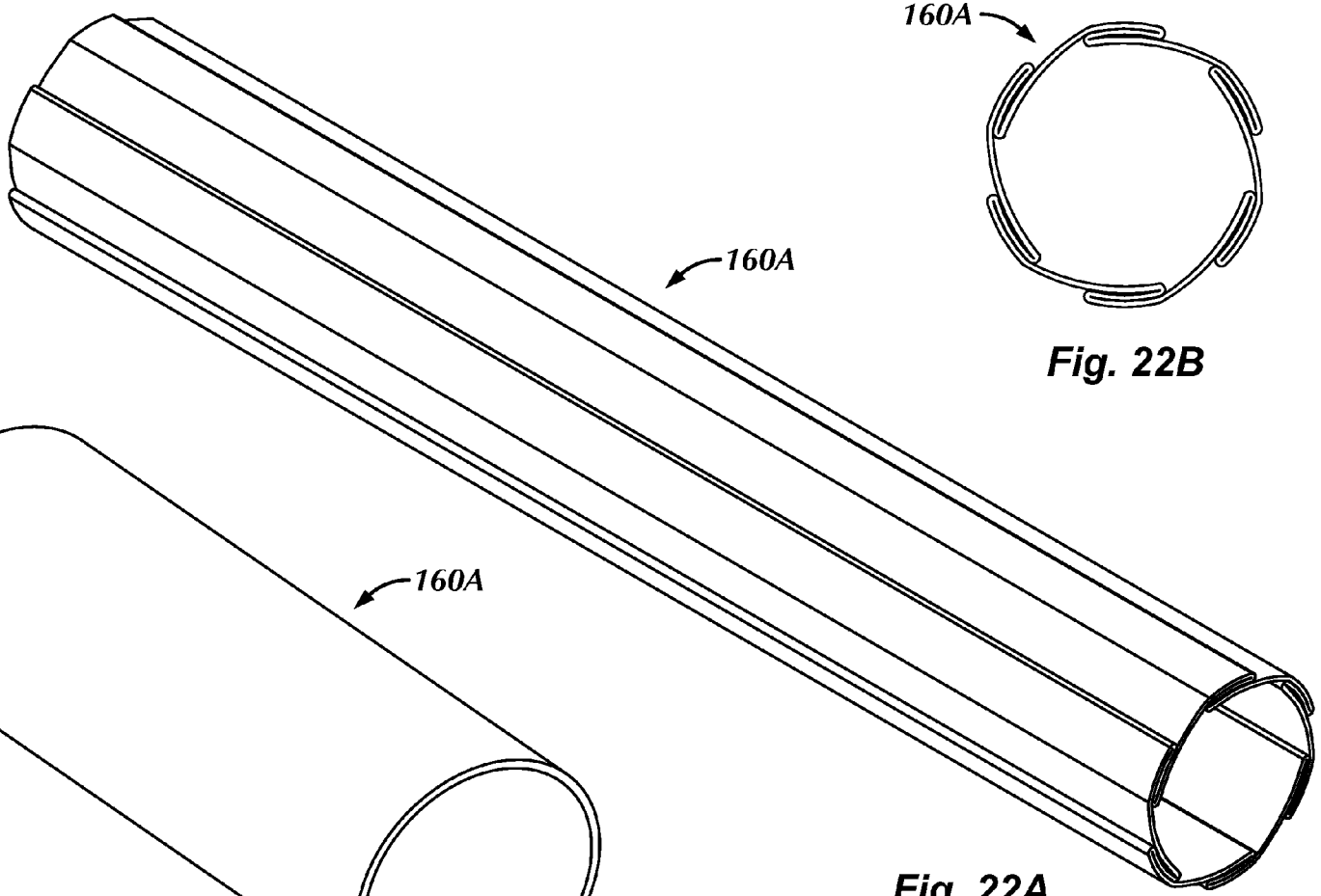
Fig. 22A
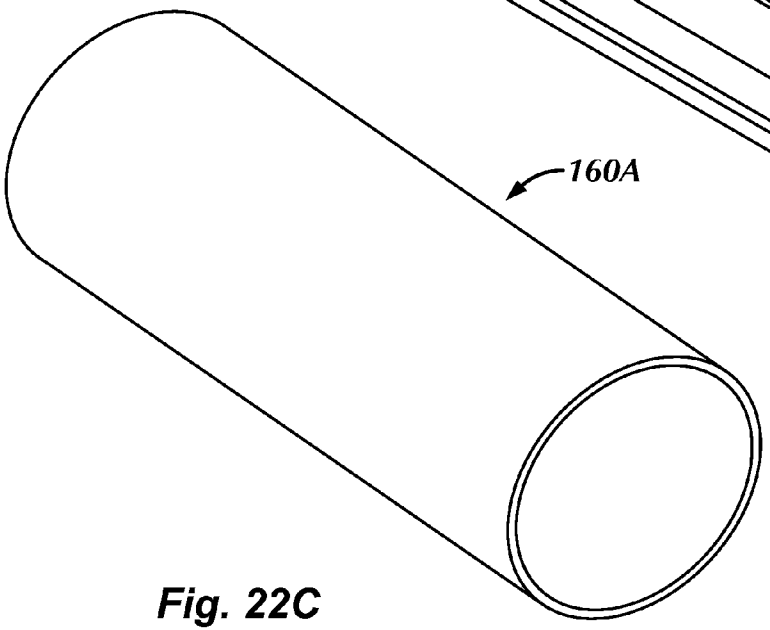
Fig. 22C

HEAT APPLIED

WELLBORE ISOLATION TOOL USING SEALING ELEMENT HAVING SHAPE MEMORY POLYMER

CROSS-REFERENCE TO RELATED APPLICATIONS

This application claims the benefit of U.S. Provisional Appl. Ser. No. 61/174,904, filed 1 May 2009, and claims the benefit of PCT Appl. Ser. No. PCT/US10/33161, filed 30 Apr. 2010, which are incorporated herein by reference and to which priority is claimed.

BACKGROUND

Operators deploy packers and bridge plugs downhole to isolate portions of a borehole for various operations. There are several challenges for such tools. Typically, the packer or bridge plug has a deformable element used to form a seal against the surrounding borehole wall. When being deployed, the deformable element may need to pass through a restriction that is smaller than the diameter of the borehole where the element is to be set. Consequently, the deformed element's size can be limited by the smallest diameter restriction through which it will deploy.

Once deployed at the desired location, the deformable element can then be set by compression, inflation, or swelling depending on the type of element used. Swellable elements take a considerable amount of time (e.g., several days) to swell in the presence of an activating agent, and the swellable elements tend to overly extrude overtime. When an inflatable element is used, it deploys in a collapsed state and then inflates when properly positioned. Unfortunately, the inflatable element can become damaged, can be difficult to implement, and can be affected by changes in downhole temperatures.

In a conventional approach, the packers or plugs use a compression set element having a sleeve that is compressed to increase the element's diameter to form a seal. Compressing such elements can require a great deal of force and a long stroke. To seal against a larger annulus, the sleeve for compressing the element may need to be rather long. Unfortunately, the sleeve may buckle or twist when compressed, leaving unsealed or weak passages on its outer surface where leaking can occur.

Designs for packers and plugs must also deal with extrusion that can occur when packing elements are set. During extrusion, the sealing element's material tends to flow into any gap between the seal bore and a gage ring. If the extrusion is severe, enough of the element's material will no longer be able to maintain a seal with the surrounding borehole wall because it has instead extruded into the gap.

Problems with extrusion also occur with O-rings. Therefore, thermoplastics are often used as back-up rings to stop the extrusion in applications having O-rings. Although the thermoplastic's rigidity helps prevent extrusion, this rigidity makes thermoplastic less useful for packing elements. To create a seal with the wellbore, packing elements must expand outward (circumferentially), and the rigidity of thermoplastics makes them less suited for such an application. Additionally, retrievable packers have to be able to return to a run position to pass through restrictions when running out of hole, which may not be possible with thermoplastics.

One current method of reducing extrusion uses garter springs molded inside the packing elements. These garter springs can expand circumferentially and inhibit extrusion when the packing element is set. Unfortunately, the windings of the springs spread apart from each other when expanded, and this creates gaps through which the packing element's material can extrude.

Another approach to reduce extrusion uses less elastic materials on the ends of the packing elements to contain a more elastic sealing material in the middle of the packing element. The end material needs the elasticity to expand, but also needs the rigidity to resist extrusion. When the extrusion gap is large, finding the right balance between rigidity and elasticity proves difficult.

Some external types of anti-extrusion devices can also be used to prevent extrusion of packing elements. Split rings are one such device that can expand during setting of the packing element and can even engage the surrounding wall of the wellbore or tubular. When the split ring expands, however, the split in the ring creates a large gap through which the element's material can extrude. To overcome this, two split rings are often used with the splits in the rings being offset. Yet, when the packing element's material extrudes into and under these rings, they often must be removed from the well by milling.

Inflatable packers have an inflatable packer element that can be inflated to engage a surrounding sidewall of a tubular. The inflatable element typically has a bladder and outer armor, covers, ribs or the like. During inflation, the inflatable element may develop undesirable folds (commonly referred to as Z-folds) that can compromise any resulting seal. Dealing with the formation of Z-folds has been addressed in the art using techniques such as disclosed in U.S. Pat. Nos. 5,605,195 and 6,752,205.

Shape memory polymers (SMP) are materials known in the art that have shape memory effects. The polymer is processed to receive a permanent shape and is then deformed into a temporary shape using a program process. Typically, this process involves heating up the polymer, deforming it, and then cooling it down, for example. Once programmed, the polymer is fixed in its temporary shape, but the permanent shape is essentially stored. Subsequently heating up the polymer above its transition temperature causes the polymer to revert back to its permanent shape, and cooling down solidifies the material.

Shape memory polymers are different from the types of swelling elastomers used for swellable elements on packers. Swellable elastomers swell in the presence of an activating agent, such as water, hydrocarbon, or other fluid. When the swellable elastomer swells, it absorbs the fluid, changes its volume, and becomes softer as it swells. Shape memory polymers are activated differently by a stimulus that causes the polymer to revert from a temporary shape back to a stored permanent shape of the material. Although the Shape Memory Polymer changes shape, it does not absorb an agent and essentially maintains the same volume.

Shape memory polymers have been described for use in the medical field, for example, in U.S. Pat. No. 6,872,433. These polymers have also been described for use in downhole applications, for example, in U.S. Pat. Nos. 6,896,063 and 7,104,317, as well as in U.S. Pat Pub. Nos. 2005/0202194, 2007/0240877, and 2008/0264647.

SUMMARY

Downhole tools, such as packers, bridge plugs, and the like, use shape memory polymer (SMP) materials on packing or sealing elements when deployed downhole. In one implementation, a downhole tool has an inflatable element disposed on a mandrel of the tool. The inflatable element can be inflated to an inflated state to engage a surrounding sidewall and create a seal in a downhole annulus. At least a portion of the inflatable element is composed of a shape memory polymer and activates from a first state to a second state in response to a predetermined stimulus. In the first state, the SMP portion of the inflatable element situates close to the mandrel, whereas the portion in the second state distends away from the mandrel. An inflator disposed on the mandrel inflates the inflatable element to the inflated state.

The SMP portion of the inflatable element can be a bladder composed of the SMP material. Alternatively, the SMP portion can be a stent disposed internally to a bladder, externally to a bladder, or incorporated into material of a bladder. The stent can comprise longitudinal slats, interwoven slats, or a spring structure. The tool can also include a local activator disposed on the mandrel for changing the SMP portion from the first state to the second state. Moreover, a deployment tool deploying downhole relative to the tool can include such an actuator.

The predetermined stimulus can include an application of light, magnetic field, heat, ultrasound, fluid, chemical stimulant, exothermic reaction, change in pH, radiation, or electricity to the activatable element.

In another implementation, a downhole tool has a gage ring and a packing element disposed adjacent one another on a mandrel. The packing element is composed of an elastomeric material compressible by movement of the gage ring. An activatable element composed of a shape memory polymer is associated with the packing element. For example, the activatable element can be incorporated into the packing element, disposed on the mandrel between the packing element and the gage ring, or disposed on the gage ring. The activatable element activates from a first state to a second state in response to a predetermined stimulus. When in the first state, the activatable element allows the tool to run downhole. By contrast, the packing element in the second state blocks extrusion of the elastomeric material of the packing element into a gap between the gage ring and a surrounding sidewall.

In another implementation, a downhole tool has a packing element and gage ring disposed on a mandrel adjacent one another. The packing element is composed of an elastomeric material, but the gage ring is at least partially composed of a shape memory polymer. During use, the gage ring can be moved to compress the packing element. The SMP material of the gage ring can be activated to block extrusion of the elastomeric material of the packing element into a gap between the gage ring and a surrounding sidewall.

In yet another implementation, a downhole tool has at least one packing element disposed on a mandrel. This packing element is composed of a shape memory polymer. The packing element has a first state in which the packing element situates close to the mandrel and has a second state in which the packing element distends away from the mandrel to engage a surrounding sidewall. The packing element is activated from the first state to the second state by a first predetermined stimulus. This packing element can further have a third state in which the packing element situates close to the mandrel. The packing element is activated from the second state to the third state by a second predetermined stimulus.

BRIEF DESCRIPTION OF THE DRAWINGS

FIGS. 22A through 25C show programmed and permanent shapes used for inflatable packer elements.

FIGS. 37A-37C shows a seal array using seals composed of SMP material on a tool having a sliding sleeve or the like.

DETAILED DESCRIPTION

Figure 1A:
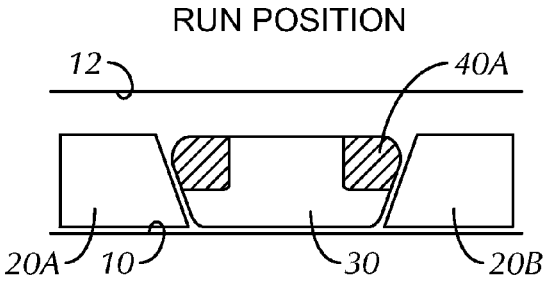
FIGS. 1A through 12B illustrate anti-extrusion devices using shape memory polymer (SMP) materials for a downhole tool.

A. Anti-Extrusion Devices for Packing Elements Using Shape Memory Polymer

FIGS. 1A through 12B illustrate anti-extrusion devices using Shape Memory Polymer (SMP) materials for a downhole tool. The anti-extrusion devices can switch from rigid to elastic, can have a "memorized" shape, and can "lock" in a deformed shape.

As is known, Shape Memory Polymer (SMP) materials exhibit a dual shape capability. The SMP material can change its shape in a predefined way from a temporary shape B to a permanent shape A when exposed to a stimulus. The permanent shape A is defined by initial processing of the SMP material. The temporary shape B, however, is determined by applying a process called programming, which involves applying pressure, heat, stress, and the like according to techniques known in the art that depend on the particular SMP material used and the programmed shape desired. Thus, the SMP material is initially processed into its permanent shape A and then deformed and programmed into its programmed or temporary shape B. When a stimulus is applied (e.g., heat increasing the temperature of the SMP material above its glass transition temperature), the SMP material reverts from its temporary, programmed shape B back to its initial permanent shape A.

As shown in FIG. 1A through 6B, the anti-extrusion devices 40 can be used internal to or as an integral part of a sealing element 30 of the downhole tool. As shown in FIGS. 7A through 12B, other anti-extrusion devices 50 can be used external to or as a separate device from the sealing element 30. The anti-extrusion devices 40/50 are composed of an SMP material, and the sealing element 30 can be composed of a conventional elastomer, such as nitrile or other suitable material used for a packer. The internal types of anti-extrusion devices 40 can be bonded, molded, extruded, or wrapped into the sealing element 30 using techniques available to those skilled in the art for combining two types of elastomers together. Both of the devices 40/50 can also be used in conjunction with other devices such as garter springs, aramid materials, etc. These external types of anti-extrusion devices 50 are composed of SMP and can also be used in conjunction with other devices, such as garter springs, Kevlar, etc.

The devices 40/50 have an initial run-in state and an anti-extrusion state. In one implementation, the run-in state is the temporary, programmed shape of the SMP material of the device 40/50. On the other hand, the anti-extrusion state is the permanent shape of the SMP material of the device 40/50. Thus, the run-in state for the temporary shape involves a smaller, tighter, or more compact shape of the device 40/50 as it is maintained in a low profile on the downhole tool 10 along with the conventional packer element 30. The permanent shape of the SMP material of the device 40/50, therefore, involves a larger, expanded, or less compact shape of the device as it increases toward the surrounding sidewall and prevents extrusion of the conventional packer element 30.

In one implementation, the SMP material of the device 40/50 is exposed to a stimulus to activate it from its temporary compact shape to its permanent expanded shape. The stimulus can be applied before, during, or after the conventional packer element 30 has been set using standard procedures, and the timing of the stimulus in conjunction with the conventional setting procedures can be designed to enhance the seal and anti-extrusion for a given implementation. Depending on the seal produced, the downhole tool may or may not be retrievable without milling because the permanent shape of the device 40/50 may prevent retrieval.

In another implementation, the SMP material of the device 40/50 has a permanent shape that is smaller, tighter, or more compact than its programmed shape. The tool 10 can be deployed with the devices 40/50 in their programmed state, and the device 40/50 can mechanically expanded via external force during the procedures for setting the conventional packing element 30. The properties of the SMP material and its position on the packing element 30 thereby provide anti-extrusion benefits. As part of the procedure for releasing the tool, the SMP material's glass temperature (Tg) is exceeded using a stimulus to cause the device 40/50 to transition from its programmed state to its permanent compact shape to facilitate retrieval. Alternatively, the stimulus is applied before or while the conventional packer element 30 is set so that the SMP material returns to its compact shape while set to enhance anti-extrusion by boosting and increasing anti-extrusion properties. Depending on the seal produced, the downhole tool may or may not be retrievable without milling because the permanent shape of the device 40/50 may prevent retrieval.

In yet another implementation, the tool 10 can be deployed with the devices 40/50 in their manufactured state. To set the tool 10, the device 40/50 can be mechanically shaped via external force during the setting procedures and can be concurrently subjected to temperature to program the device 40/50 into this set shape. As part of the procedure for releasing the tool, the devices 40/50 can be heated so that the SMP material's glass temperature (Tg) is exceeded using a stimulus. This can cause the device 40/50 to transition from its programmed shape back to its permanent manufactured shape to facilitate retrieval.

With the benefit of the above discussion, it will be appreciated that multiple permanent shapes of SMP anti-extrusion devices 40/50 can be used where the devices 40/50 can be programmed with different shapes for set, run, and/or release. The various shapes both permanent and temporary can also be tailored to specific applications, such as shapes for large extrusion gaps, shapes for small extrusion gaps, shapes for high-pressure differentials, etc.

Discussion now turns to various configurations of the internal types of anti-extrusion devices 40. A first internal type of anti-extrusion device shown in FIG. 1A has devices 40A incorporated as garters into a sealing element 30. For its part, the sealing element 30 is disposed on a mandrel 10 of a downhole tool, such as a packer or plug, and is set between movable gage rings 20A-B. When deployed downhole, the sealing element 30 positions in the annulus between the mandrel 10 and a sidewall 12 of a borehole, tubular, or the like. When the downhole tool is energized by any of the known methods, the two gage rings 20A-B are moved together and compress the sealing element 30, causing it to protrude outward to engage the surrounding sidewall 12.

Figure 1B:
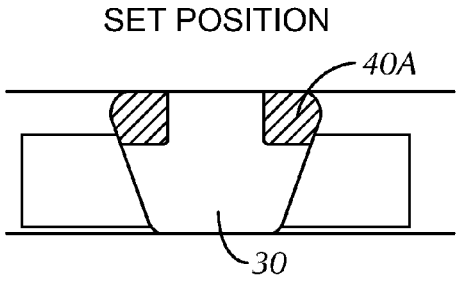

In FIG. 1A, the sealing element 30 has the anti-extrusion devices 40A affixed to exterior edges of the element 30 in FIG. 1A. These anti-extrusion devices 40A are composed of an SMP material that has an initial shape for the run position as shown in FIG. 1A. The sealing element 30 can be set as shown in FIG. 1B, and the anti-extrusion devices 40A inhibit the tendency of the sealing element 30 to extrude into the surrounding gaps along the corners of the element 30. After being set and then released, the SMP material of the anti-extrusion devices 40A returns automatically to its initial run-in shape for retrieval, assisting the sealing element 30 in returning to a run-in state as well.

Figure 2A:
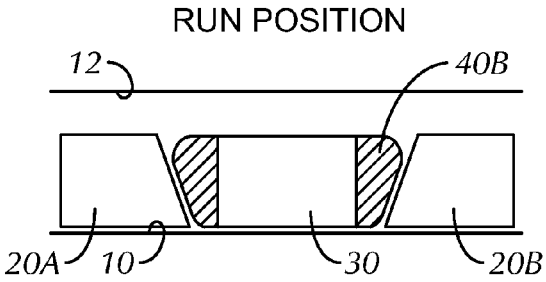
Figure 2B:
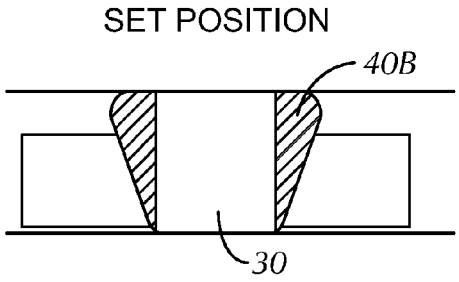
Figure 3A:
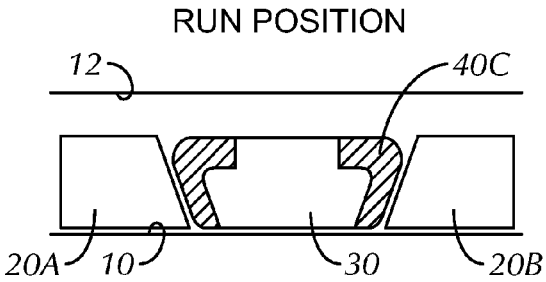
Figure 3B:
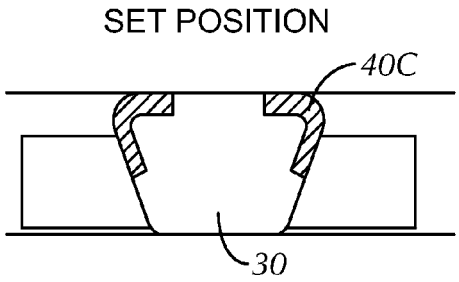

In addition to being affixed to the corners as in FIGS. 1A-1B, the internal types of devices 40 can be incorporated into different parts of the sealing element 30. Anti-extrusion devices 40B in FIGS. 2A-2B are affixed along the entire sides of the sealing element 30, and the devices 40C in FIGS. 3A-3C enclose both the sides and the corners of the sealing element 30. In addition, the device 40E in FIGS. 5A-5B fully encloses the entire sealing element 30.

Figure 4A:
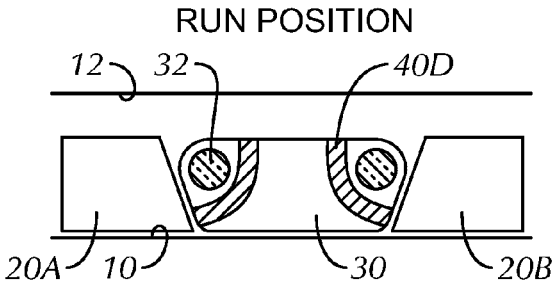
Figure 4B:
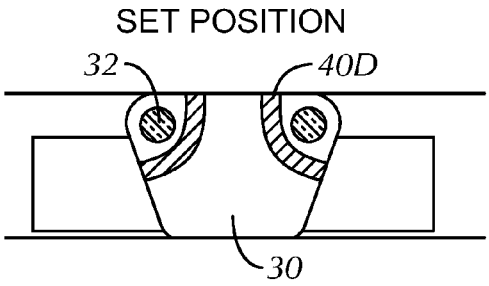
Figure 5A:
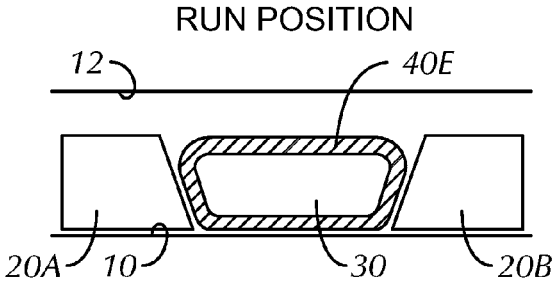
Figure 5B:
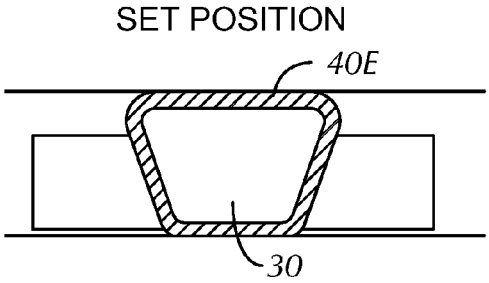
Figure 6A:
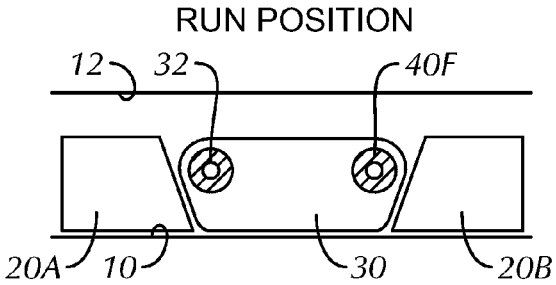
Figure 6B:
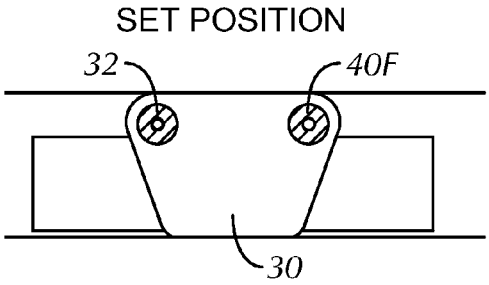

In FIGS. 4A-4B, the anti-extrusion devices 40D position internally at corners of the sealing element 30, and garter springs 32 position around the sealing element's corners. These garter springs 32 can be composed of conventional materials or composed of shape memory polymer. In FIGS. 6A-6B, for example, the anti-extrusion devices 40F are garter springs 32 positioned internally at corners of the sealing element 30. The devices 40F can have rubber and shape memory polymer on the inside or outside thereof, or the devices 40F may be composed entirely of shape memory polymer.

Figure 7A:
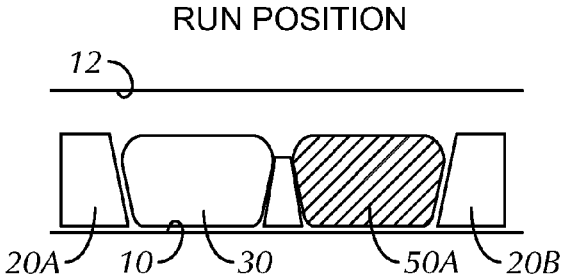
Figure 7B:
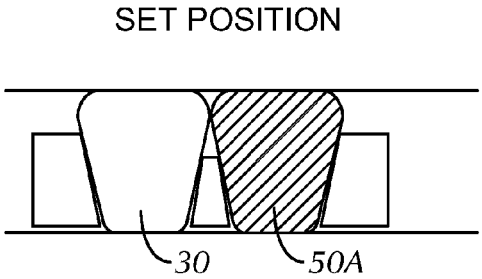

Turning now to the external types of anti-extrusion devices, a first device 50A in FIGS. 7A-7B is disposed around the mandrel 10 adjacent the sealing element 30. The device 50A abuts one of the gage rings 20B and has an intermediate gage ring 22 disposed between the device 50A and the side of the sealing element 30. In this and other external types, the other side of the sealing element 30 can have a similarly arranged external device 50, even though only one is shown in the Figures.

Figure 8A:
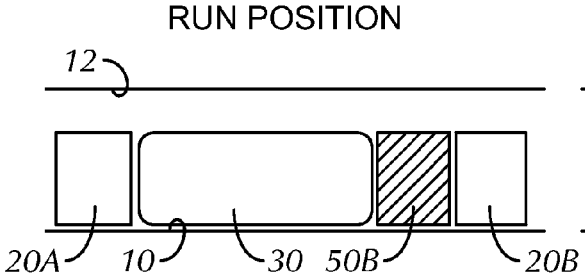
Figure 8B:
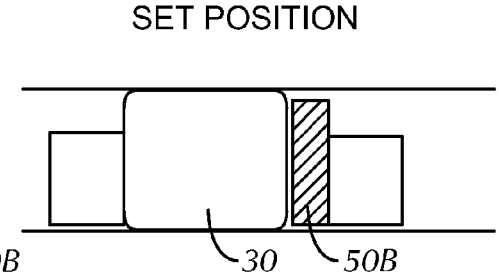
Figure 9A:
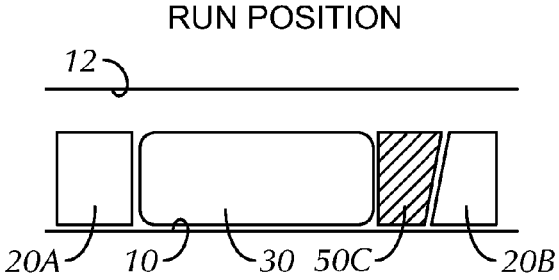
Figure 9B:
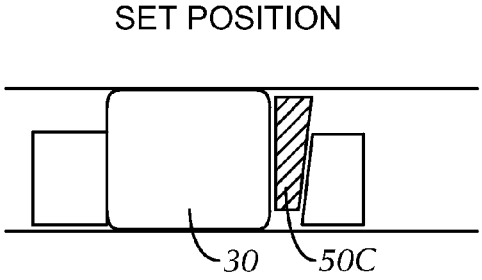
Figure 10A:
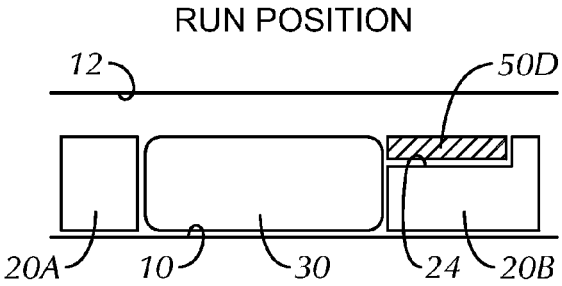
Figure 10B:
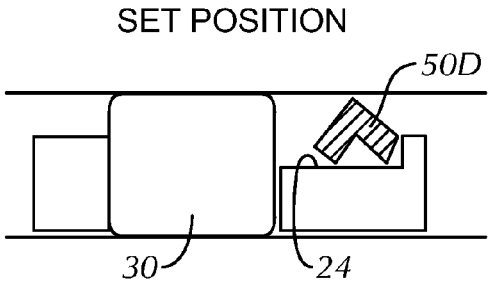
Figure 11A:
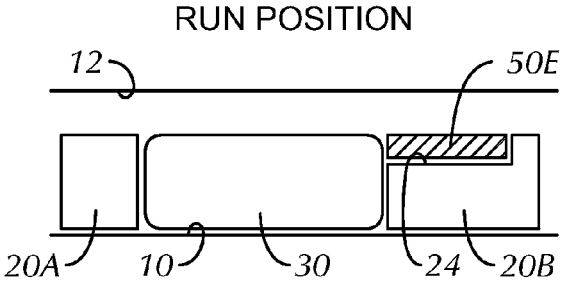
Figure 11B:
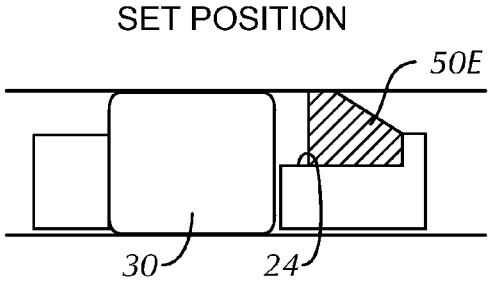
Figure 12A:
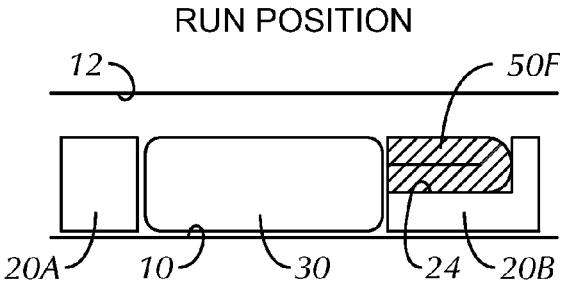
Figure 12B:
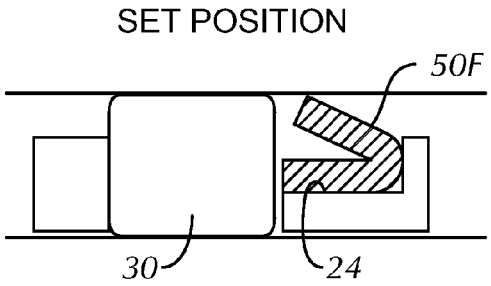

In FIGS. 8A-8B, the anti-extrusion device 50B directly abuts against the side of the sealing element 30 without an intermediate gage ring. The device 50C in FIGS. 9A-9C does the same but has an angled side adjacent the gage ring 20B. This angled side produces a wedge effect that forces the device 50C toward the surrounding wall.

In FIGS. 10A-10B, 11A-11B, and 12A-12B, the anti-extrusion devices 50D, 50E, and 50F are incorporated into the gage ring 20B. For example, the entire gage ring 20B can be composed of an SMP material that can prevent extrusion by being activated to a permanent shape. Alternatively, only a portion of the gage ring 20B may be composed of an SMP material. For example, the devices 50D (FIG. 10A), 50E (FIG. 11A), and 50F (FIG. 12A) can position in a recess or pocket 24 in the ring 20B. The device 50D (FIG. 10B) has a set state in which its middle extends outward to the sidewall 12 to close off the sealing element 30 from the extrusion gap. The device 50E (FIG. 11B) has a set state in which its edge extends outward, and the device 50F (FIG. 12B) has a set state in which it unfolds outward. Device 50F could be reversed to enable boosting and prevent pressure migration.

To activate either of these internal or external anti-extrusion devices 40/50, a stimulus is introduced according to techniques discussed in more detail later. Various types of stimulus can be used to activate the SMP devices 40/50. Typically, the stimulus induces some form of heating of the SMP devices 40/50 above the SMP material's glass transition temperature $T_g$, causing the SMP material to transition so the device 40/50 changes shape from its temporary compact programmed state B to its larger initial processed state A. The types of stimulus that can be used include, but are not limited to, light, magnetic fields, direct heat, ultrasound, immersion in a fluid (e.g., water), chemical stimulation creating exothermic reaction or change in PH, radiation, and electricity.

B. Packer Elements Using Shape Memory Polymer

Previously discussed arrangements for downhole tools, such as packers, plugs, or the like, used SMP materials in anti-extrusion devices 40/50 incorporated into the packing elements of the tool. In arrangements discussed below, packing elements of a downhole tool are composed either entirely or partially of SMP material to facilitate deployment, energization, and/or retrieval of a downhole packing tool.

1. Cup Packer or Stackable Element Using Shape Memory Polymer

Figures 13A, 13B:
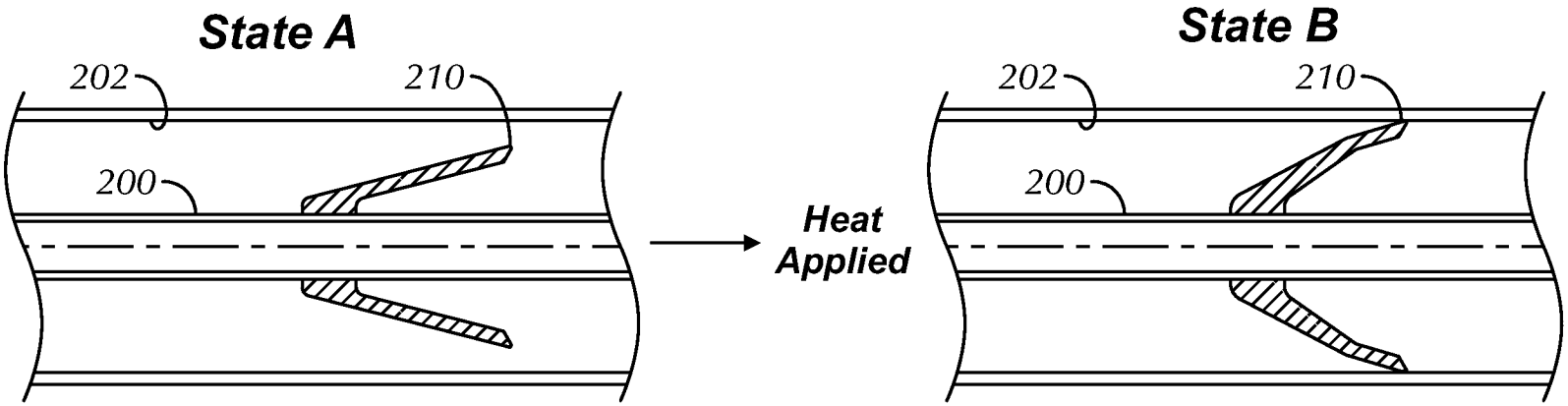
FIGS. 13A-13B shows a cup packer composed of an SMP material being activated from an initial state to an at least partially sealed state.

FIGS. 13A-13B shows a cup packer 210 composed of SMP material being activated from an initial state (FIG. 13A) to an at least partially sealed state (FIG. 13B). The cup packer 210 is disposed on a mandrel 200 of a downhole tool or the like positioned in casing or tubing 202. The cup packer 210 uses shape memory polymers to change shape from a run-in state (FIG. 13A) to a set state (FIG. 13B) downhole once exposed to a programmed temperature or other stimulus. The cup packer 210 is initially processed in a cup shape (FIG. 13B) designed to engage a specific size of casing 202. The cup packer 210 is then programmed to a compact smaller diameter shape (FIG. 13A) by deformation induced from heat and compression or other stimulus.

As the tool is deployed downhole, the cup packer 210 has its reduced programmed shape (FIG. 13A) so that it can pass through smaller diameter portions of the casing or tubing 202. Once deployed to a desired position, the cup packer 210 is activated by the application of heat or other stimulus so that the SMP material transitions to the permanent set state (FIG. 13B). In this way, the cup packer 210 can seal the annulus between the mandrel 200 and tubing 202. Mechanical loads can be applied after the initial shape change to further energize the seal produced with the packer 210.

2. Stackable Cup Element Using Shape Memory Polymer

Figures 14A, 14B:
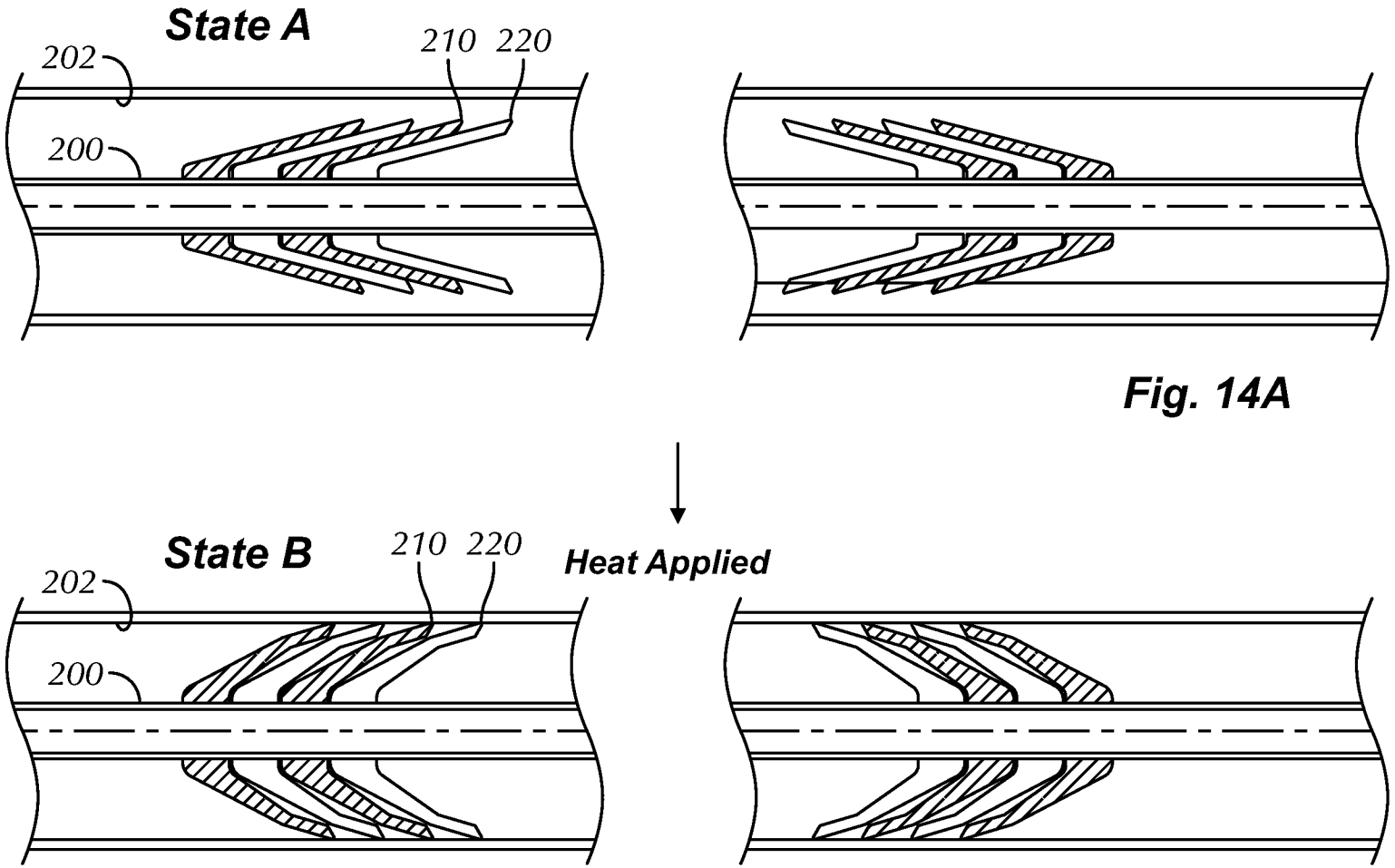
FIGS. 14A-14B shows a stack of cup packers, some of which are composed of an SMP material.

As shown in FIGS. 14A-14B, a stack of such cup packers 210 composed of SMP material can be used in multiple layers. Packers 220 composed of conventional materials can also be used in the stack if desired, or all of the packers 220 can be composed of SMP material. Being stacked in multiple layers, the cup packers 210/220 form redundant seals in the annulus between the mandrel 200 and tubing 202. The stacks of packers 210/220 can also be placed on the mandrel 200 in opposing positions to provide a bi-directional sealing capability once in contact with the tubing 202. Furthermore, an applied compressive mechanical load can be used to increase the element pack off and energize the system.

3. Cup Packer Using SMP Material with Triple-Shape Capability

As discussed previously, convention SMP materials can transition between two states. New generations of SMP materials have been developed via a joint venture between GKSS Research Center in Teltow, Germany and the Massachusetts Institute of Technology. These SMP materials can be programmed and deformed into three distinct shapes utilizing two different glass transition temperatures $T_{g1}$ and $T_{g2}$. This allows the polymer to change from an initial state A to secondary shape B via a first stimulus(e.g., temperature increase above $T_{g1}$) and then to change from the secondary shape B to a third shape C via a secondary stimulus (e.g., temperature increase above $T_{g2}$).

Figure 15A:
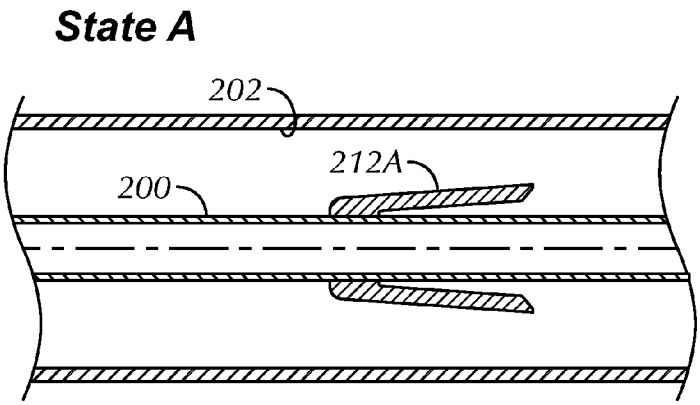
FIGS. 15A-15C show a cup packer composed of an SMP and having three shapes.
Figure 15B:
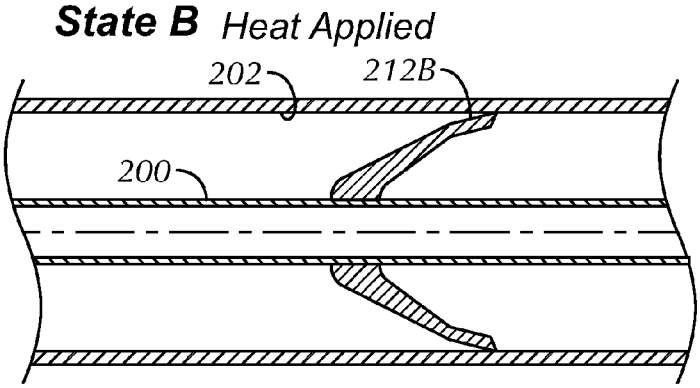
Figure 15C:
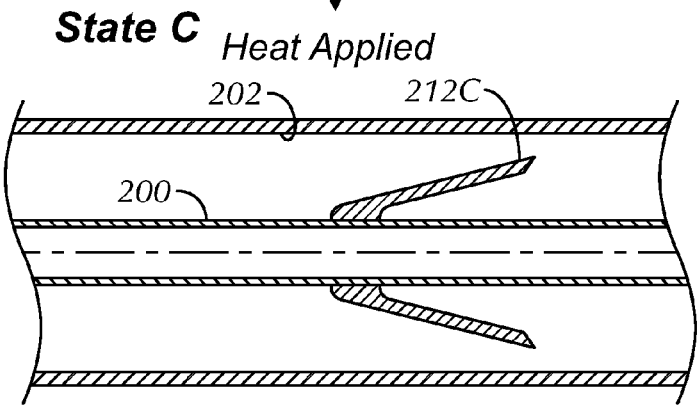

FIGS. 15A-15C show a cup packer 212 composed of SMP material having three shapes. This packer 212 is composed of a triple shape memory polymer that has a composite of different polymers with varying glass transition temperatures. The packer 212 is formed with an initial state A representing the run-in position of the packer 212A (FIG. 15A). This initial state A allows the cup packer 212 to pass through reduced diameters while being run downhole.

Once at the sealing location, the copolymer is heated beyond a first transition temperature so that the shape of the packer 212B expands from the run-in state (FIG. 15A) to a sealing state (FIG. 15B) in contact with the casing or tubing 202. This first transition temperature is above the operational temperature of the packer 212 in the wellbore. At a later time when retrieval is necessary, the copolymer is heated above a second transition temperature (greater than the first temperature), and the shape of the packer 212C shifts to a retracted state (FIG. 15C) for subsequent removal from the wellbore. This retracted state can allow the packer 212C to pass through reduced diameters while being removed from the wellbore.

4. Sleeve Packer Using SMP Material

Figure 16A:
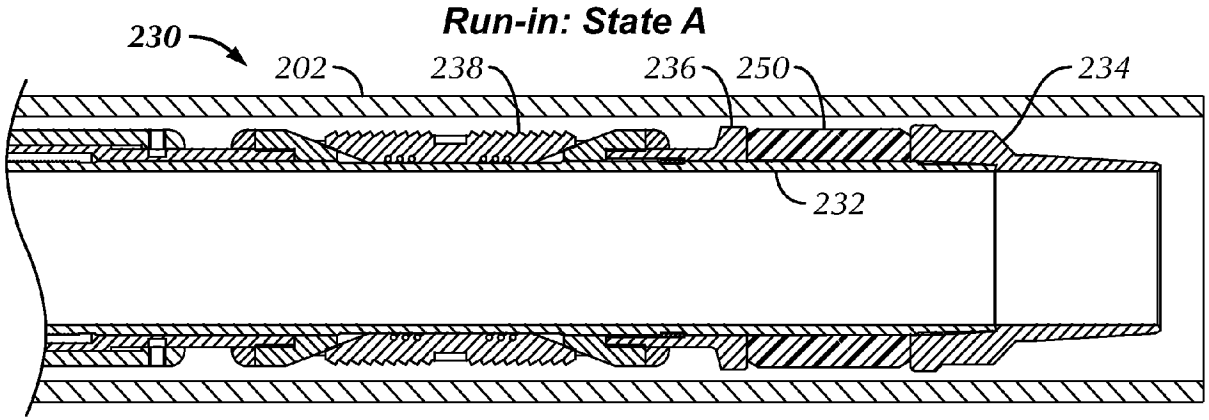
FIGS. 16A-16D show portion of a packer having a packing element composed of an SMP material with three shapes.
Figure 16B:
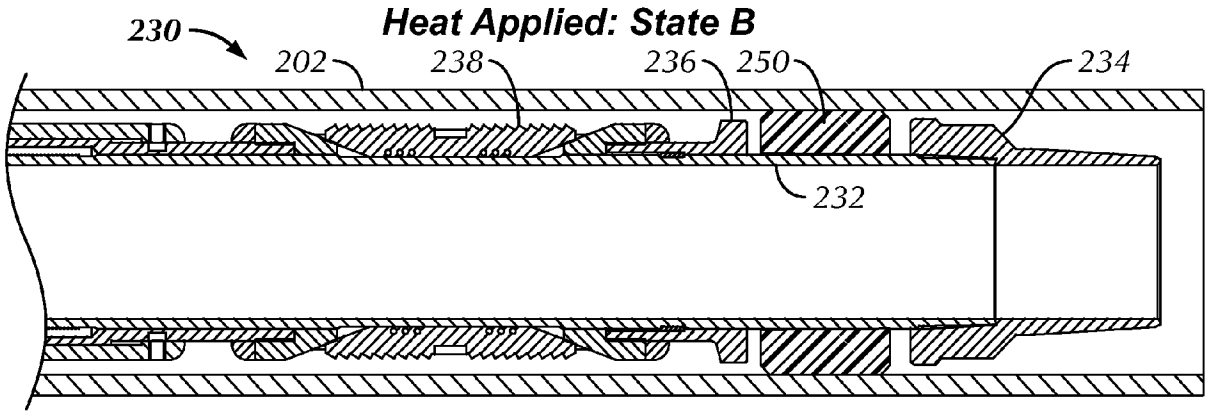
Figure 16C:
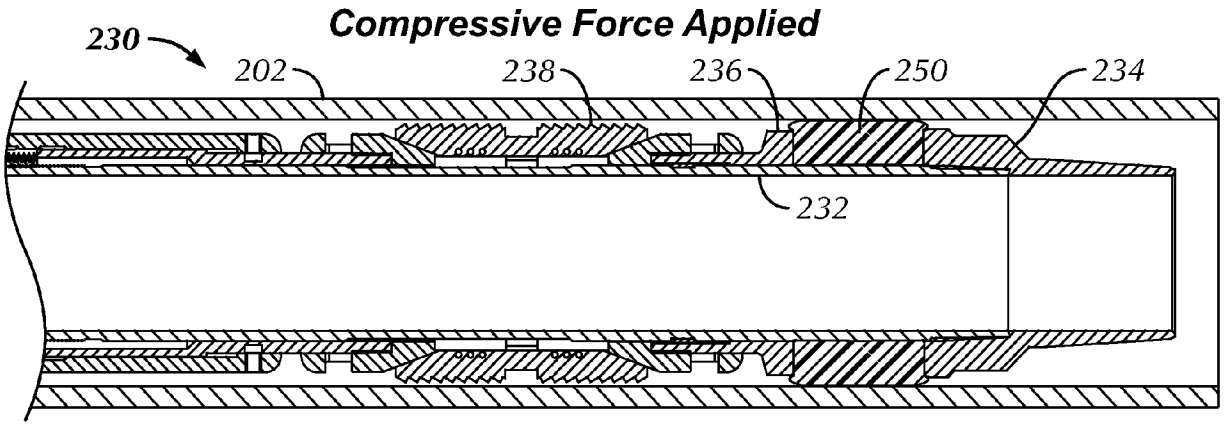
Figure 16D:
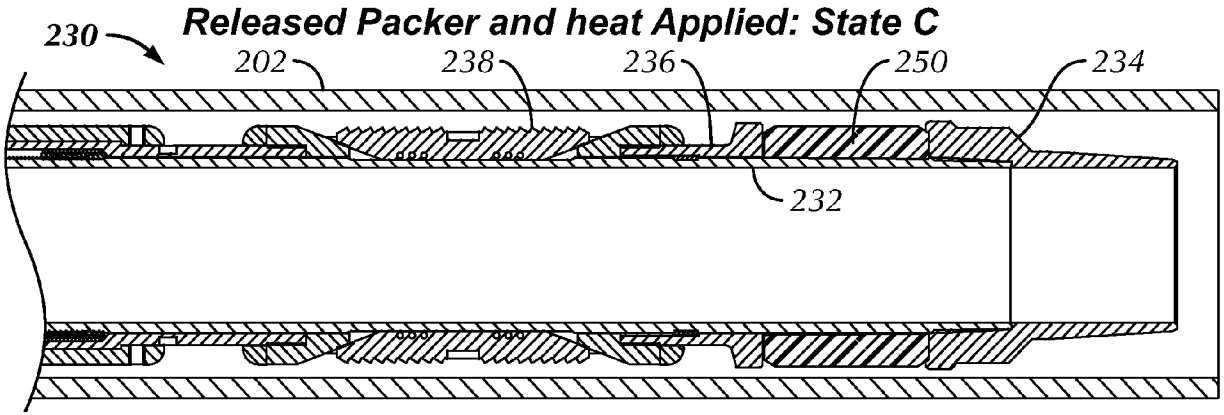

FIGS. 16A-16C shows portion of a packer or other tool 230 having a packing sleeve 250 composed of SMP material with two shapes. The packer 230 has a mandrel 232, shoulders 234/236, and slips 238. The packing sleeve 250 has an initial shape in state A (FIG. 16A) in which the sleeve 250 is held against the mandrel 232 for running the packer downhole. Once at the sealing location, the SMP material is heated beyond its transition temperature $T_g$ so that the shape of the packing sleeve 250 expands from the run-in state A (FIG. 16A) to a sealing state B (FIG. 16B) in contact or almost in contact with the surrounding tubular 202. This transition is done without compression from the packer 230 itself and essentially presets the packing sleeve 250.

Then, as shown in FIG. 16C, the packer 230 is activated to move the shoulders 234/236 towards one another so as to compress the sleeve 250 and to engage the slips 238, thereby packing off the annulus of the tubular 202. The compressed packing sleeve 250 seals off the annulus between the packer 230 and the tubing 202. This two shape SMP packer system described above is representative of a permanent packer application, or at a later time when removal or retrieval is necessary, the packer 230 is disengaged so that the sleeve 250 is uncompressed. Depending on how the sleeve 250 remains engaged, the packer 230 may be removable from the tubular 202, or the packer 230 may need to be milled.

As an alternative to the two shape sleeve 250 discussed above, the packer or other tool 230 in FIGS. 16A-16D can have a packing sleeve 250 composed of SMP material with three shapes. Again, the packing sleeve 250 has an initial shape in state A (FIG. 16A) in which the sleeve 250 is held against the mandrel 232 for running the packer downhole. Once at the sealing location, the SMP material is heated beyond a first transition temperature $T_{g1}$ so that the shape of the packing sleeve 250 expands from the run-in state A (FIG. 16A) to a sealing state B (FIG. 16B) in contact or almost in contact with the surrounding tubular 202. This first transition is done without compression from the packer 230 itself and essentially presets the packing sleeve 250.

Then, as shown in FIG. 16C, the packer 230 is activated to move the shoulders 234/236 towards one another so as to compress the sleeve 250 and to engage the slips 238, thereby packing off the annulus of the tubular 202. The compressed packing sleeve 250 seals off the annulus between the packer 230 and the tubing 202.

At a later time when retrieval is necessary, the packer 230 is disengaged so that the sleeve 250 is uncompressed. However, as noted previously, simply disengaging the compression of the shoulders 234/236 against the packing sleeve 250 may not sufficiently release the sleeve 250 from the tubing 202. For this reason, the SMP material is heated above a second transition temperature $T_{g2}$ (typically higher than the first temperature $T_{g1}$), and the shape of the packing sleeve 250 shifts to a third, retracted state C (FIG. 16D) for subsequent removal from the wellbore.

Although shown as a solitary component of SMP material, the packing sleeve 250 can be composed of a combination of SMP material and conventional packer material and can also include anti-extrusion devices as disclosed herein.

Using the SMP material for the packer systems discussed above can reduce the setting force required to compress/expand the packing sleeve 250 and can reduce the stroke needed to perform that compression/expansion. For example, a traditional packer system requires a compressive load to be applied to the packing sleeve using a mechanical or hydraulic mechanism to forcibly reshape the sleeve's elastomer from an unstressed run-in shape to a highly stressed packed-off shape. By using an SMP material as in current arrangements, the SMP material performs at least some of this work in reshaping. In the end, the SMP material of the packing sleeve 250 can be compressed in a packed-off state with less stress induced in the material, less setting force applied, and less stroke for a mechanical or hydraulic actuator to move against the sleeve 250.

C. Downhole Tool Using Shape Memory Alloys and Polymers

Figures 17A, 17B:
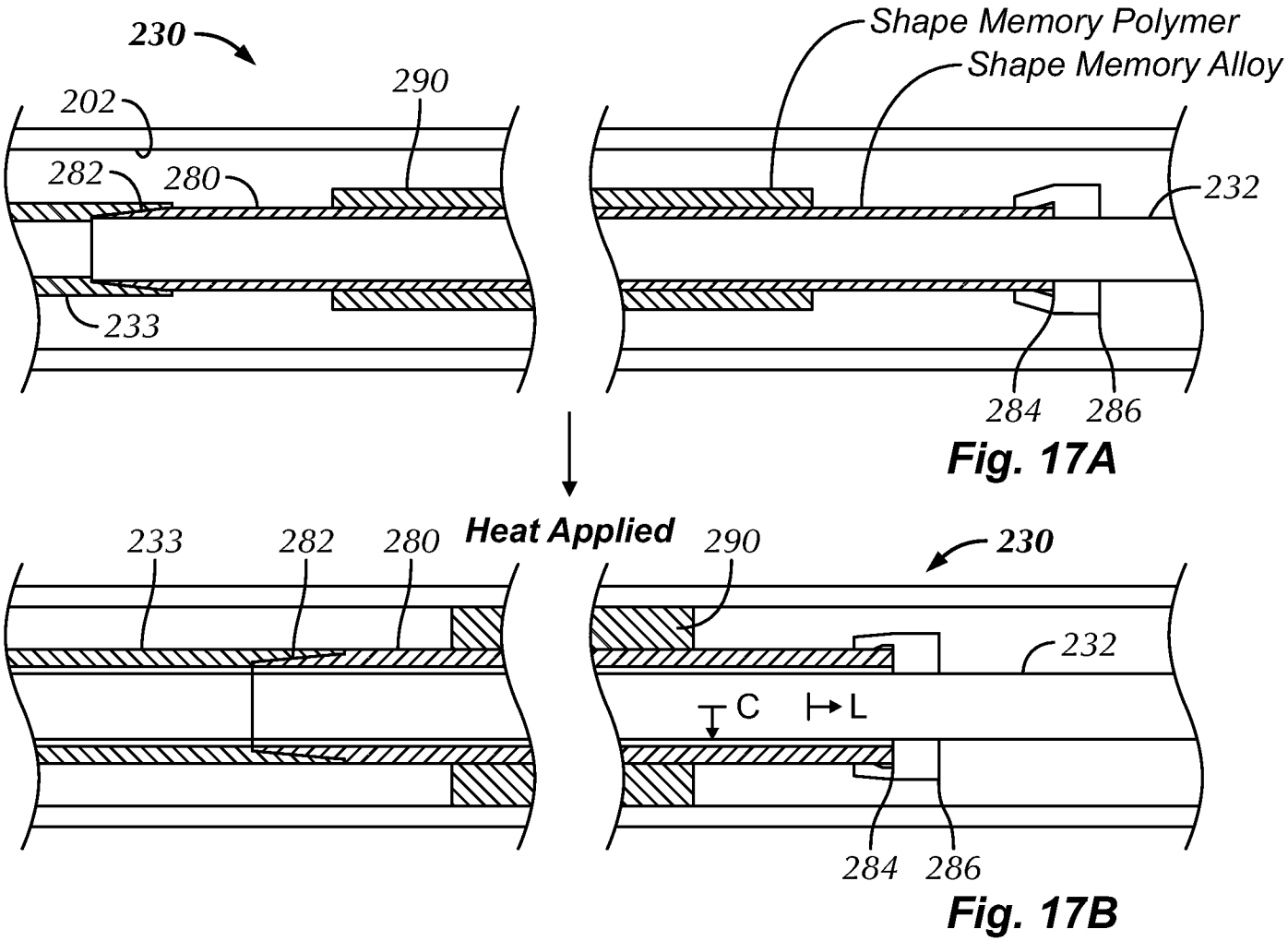
FIGS. 17A-17B show a mandrel composed of a shape memory alloy and having a packing element composed of an SMP material disposed thereon.

FIGS. 17A-17B show a tubular 280 of a Shape Memory Alloy (SMA) with a packing element 290 of Shape Memory Polymer (SMP) disposed thereon. Shape Memory Alloys (SMA) such as Nitinol (NiTi) are known for their ability to be deformed from an initial state A to a programmed state B and return to initial state A by a change in temperature beyond a transition temperature Tc. At this temperature, the alloy changes from a martensite crystal structure to austenite and can experience a return to the pre-stressed state A. This allows the SMA material to perform work that can be used in a packer or other tool 230 to provide a compressive force to engage the packing element 290 against the wellbore 202.

As shown in FIG. 17A, the SMA tubular 280 can be part of the mandrel of the packer 230 (as shown on the left side of FIG. 17A). Alternatively, the SMA tubular 280 can be a separate tubular component disposed about an existing mandrel 232 (as shown on the right side of FIG. 17A). In either case, the SMA tubular 280 can be placed in tension and rolled to a smaller diameter with increased axial length. While deployed downhole, returning the tubular 280 to its initial pre-stressed diameter and length can thereby produce a stroke length "L" and a circumferential growth "C" to help in packing off the packing element 290. For its part, the packing element 290 composed of a Shape Memory Polymer (SMP) can expand to a permanent expanded shape due to a temperature transition to complete the pack-off.

As shown on the left side of FIG. 17A, the SMA tubular 280 can be part of the mandrel of the packer 230 and can have loose fitting threads 282 coupled to an adjoining tubular 233. When expanded as shown in the left side of FIG. 17B, the loose fitting threads 282 can fully engage the adjoining tubular 233 as the SMA tubular 280 changes shape to its initial pre-stressed shape.

In the alternative as shown on the right side of FIG. 17A, the SMA tubular 280 can be a separate component disposed on the existing housing 232 of the packer 230. The SMA tubular 280 can be held by interjoined members 284/286, such as tongue and groove, with one member 284 affixed to the SMA tubular 280 and the other member 286 affixed to the packer mandrel 232. When the SMA tubular 280 changes shape on the mandrel 232, these interjoined members 284/286 hold the tubular 280 on the mandrel 232 while accounting for the change in length L and circumference C.

To deploy the packer 230 made of the SMA/SMP configuration, the temperature of the packer 230 is controlled until the depth and operational location is reached. This can be achieved in several ways using coiled tubing (CT) or wireline. If deployed via CT, for example, colder fluids are run through the tool string and around the packer 230 to maintain a temperature lower than the transition temperature of the SMA tubular 280 and/or SMP element 290. Once at setting depth, the fluid flow is halted, and the packer 230 is allowed to heat to the local temperature of the wellbore. If this temperature is above the transition temperature of the SMA tubular 280, it will change to its expanded set state (FIG. 17B). Additional heat applied via the various techniques disclosed herein can then raise the temperature to the transition temperature of the SMP element 290 so it can then change from the initial run-in state (FIG. 17A) to the packed off state (FIG. 17B).

D. Activation Methods for SMP Materials on Downhole Tools

As discussed briefly above, a stimulus is introduced to induce some form of heating of the SMP material above its glass transition temperature to cause the anti-extrusion device or packing element to change its shape from a current set state to a programmed state. In general, the types of stimulus that can be used include, but are not limited to, light, magnetic fields, direct heat, ultrasound, immersion in water, chemical stimulation creating exothermic reaction or change in PH, radiation, and electricity.

1. Chemical Activation

For chemically induced activation, stimulating agents can be supplied to the borehole to encounter the components of SMP material (e.g., anti-extrusion devices, cup packers, packer sleeves, and other elements disclosed herein). For example, some SMP materials activate in response to immersion in water. Accordingly, operators can use existing water or fluid in the borehole or pumped water or fluid into the annulus to activate the SMP packing element. The exposure required to activate the SMP packing elements may be expected to continue for several days, for example.

An exothermic reaction or a change in PH can also be used to activate the SMP packing element. To do this, operators can introduce different fluids or chemicals in the borehole to induce an exothermic reaction or a PH change downhole that activates the SMP material. The particular chemicals or agents needed to accomplish the desired reaction or change depends on the type of SMP material used, its glass transition temperature, its chemical resistivity properties, and the chemical sensitivity of other downhole components, among other considerations familiar to those skilled in the art.

2. Local Activation

Figure 18A:
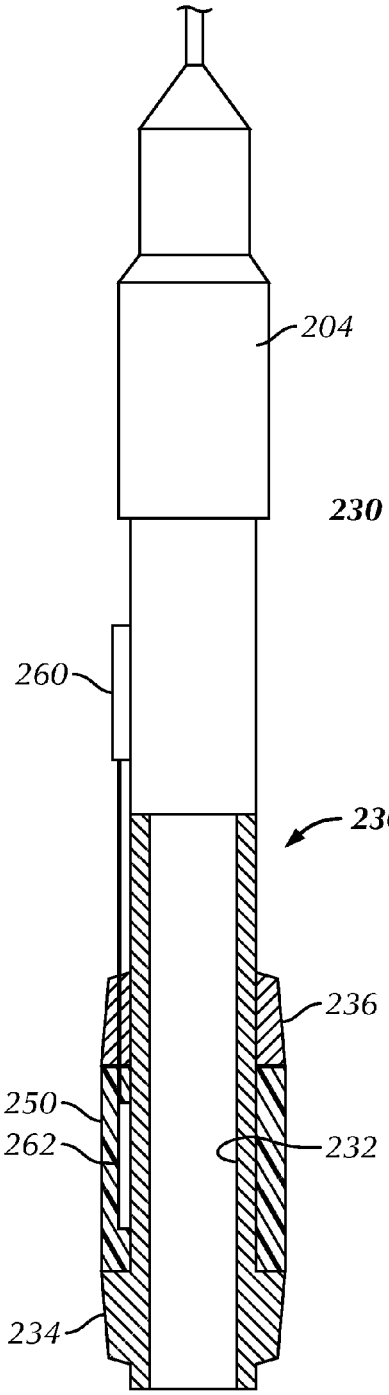
FIGS. 18A-18C show deployment techniques for a power source and stimulus source of a packer element composed of SMP material disposed on a packer.
Figure 18B:
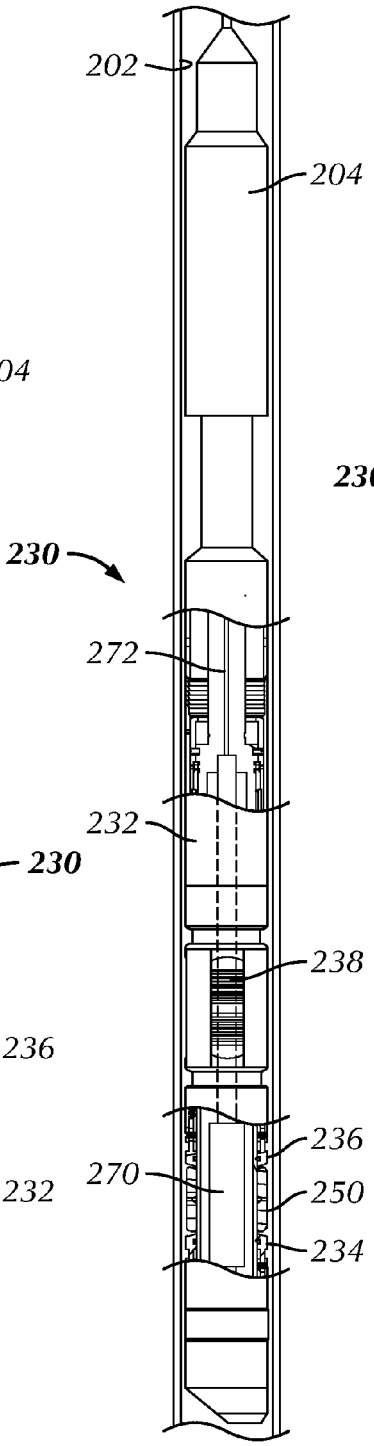
Figure 18C:
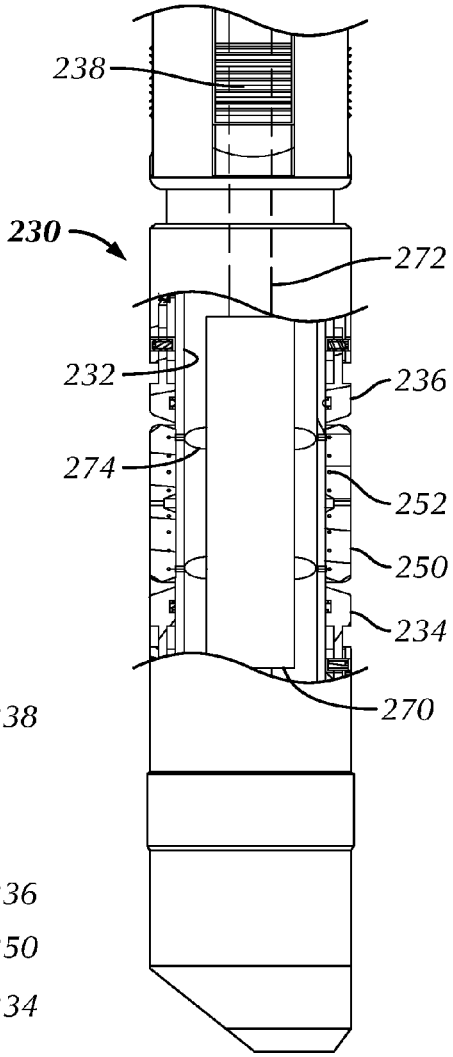

Other forms of activation can be applied more directly. FIGS. 18A-18C shows techniques in which a stimulus can be applied directly to the SMP packing element. In these examples, the downhole tool is a packer or other tool 230 having a mandrel 232, shoulders 234/236, and packing element 250 composed of SMP material; however, the techniques can be used with other arrangements disclosed herein.

In FIG. 18A, the components to apply the stimulus are mounted locally on the packer 230. The components include a power source 260 mounted on or incorporated into the packer's housing or mandrel 232. The components also include a stimulus source 262 coupled to the power source 260 and associated with the packing element 250. In this arrangement, the power source 260 can be activated by a connection to a running tool 204, an RFID device, a wireline connection, a separate wire lead, a telemetry signal, or other downhole communication technique. Once activated, the power source 260 supplies power to the stimulus source 262 to generate the stimulus to activate the SMP material of the packing element 250.

The power source 260 can include a battery source having stored power or can be a generator powered by fluid flow or the like. The stimulus source 262 can be a heating coil or electromagnet. As a heating coil, the stimulus source 262 can connect by leads to the power source 260 and can be embedded in or adjacent to the packing element 250. When current flows through the coil source 262, the generated heat can make the packing element 250 reach its transition temperature to change from its programmed state to its permanent state.

As an electromagnet, the stimulus source 262 can connect by leads to the power source 260 and can be embedded in or adjacent to the packing element 250, which can have metallic or magnetic particles or carbon nano tubes dispersed therein. As current from the power source 260 energizes the electromagnetic source 262, the electromagnetic field acting on the dispersed particles or nano tubes can generate heat in the element 250 to activate it.

3. Running/Retrieval Activation

In FIG. 18B, a tool source 270 is incorporated into the running/retrieval tool 204, which can convey power and/or activation signals to stimulate activation of the SMP material. As shown, the tool source 270 extends through the bore of the packer or other tool 230 and fits adjacent the packing element 250 disposed on the packer's mandrel 232. To activate the SMP material of the packing element 250, the tool source 270 can generate the stimulus necessary as controlled via the running/retrieval tool 204. In this example, the tool source 270 can be an electromagnetic source that generates a magnetic field sufficient to impact the packing element 250 on the outside of the mandrel 232. The packing element 250 itself can have metallic or magnetic particles or nano tubes dispersed therein that generate heat in the packing element 250 when subjected to the electromagnetic field.

In FIG. 18C, the tool source 270 is again shown disposed in the bore of the packer's mandrel 232. Here, leads or contacts 274 connect the tool source 270 to the packing element 250, which can have a heating coil 252 embedded therein. These leads or contacts 274 can pass electrical signals through the mandrel 232 if composed of appropriate metal. In the case of a composite mandrel, embedded metal leads or contacts disposed in the mandrel 232 can be provided to make contact with the source's leads 274. Power from the tool source 270 can be conducted through the leads 274 to the coil 252 in the packing element 250 to heat it to the transition temperature.

Although electromagnetic fields and current have been discussed above, other forms of stimulation could also be used. In either of the local or running/retrieval arrangements, the stimulus source (260/270) can release chemical agents, generate light, produce a magnetic field, generate ultrasonic signals, generate heat, supply electricity, or perform some other stimulating action disclosed herein to activate the SMP material of the packing element 250.

E. Forms of Activation for SMP Materials on Downhole Tools

Various forms of activation can be used for the SMP materials of the packing elements disclosed herein.

1. Conductive Heat Generation

As discussed previously, heat can be generated by providing electricity to a heating element or coil attached to the running tool or internal to the packer mandrel. A heating element or coil can also be placed internally in the packing element itself, or it can be a separate integrated component on the packer chassis. Wire leads can supply the current to the heating element. Heat can also be generated within the SMP material by dispersing conductive material within the SMP material or using a filler material with a high resistance.

To supply power for the heating element, a power pack can be deployed to provide the necessary local power downhole with a coil tubing or conventional tubing string. The power pack can be actuated by a Radio Frequency Identification Device (RFID) switch that is sent down the string to initiate the current. A hydro mechanical generator can also be used on tubing to create electricity downhole using fluid flow.

In other arrangements, heat can be generated by a heat source, heater, or heating element attached to the running tool or retrieval tool. A heating element can also be placed internally in the SMP material. Of course, temperatures in the wellbore can also provide the necessary temperature for activation in some implementations.

2. Magnetic Field

As noted previously, shape change of the SMP material of the packing elements can be induced by a magnetic field. Iron oxide, nickel zinc ferrite, or some other ferromagnetic particle compound can be dispersed within the SMP material. Applying an electromagnetic field to the compounds can thereby induce heat within the SMP material to create shape change. The temperature created by the EM field acting on the ferromagnetic compound could be controlled by Curie-Thermoregulation. The Curie Point of a ferromagnetic material is the temperature above which it loses its characteristic ferromagnetic ability (768° C. or 1414° F. for iron). Therefore, variation in particle size or volumetric dispersion can both limit and control the peak temperature of the material once the EM field is applied.

As shown previously in FIG. 18B, for example, the deployment tool 204 for the packer 230 can include an electromagnetic coil source 270. When deploying the packer 230, this source 270 is located within the bore of the packer 230 in close proximity to the packing element 250. Preferably, nonferrous metals can be used for the mechanical tool components to reduce the overall EM heating affect. The EM field can be induced in the source 270 by power supplied to the deployment tool 203 via wireline operations or even by hydro-electrical means using coiled tubing.

3. Electricity

As discussed previously, electricity can be directly applied to a heating element via a power source located on the packer 230 or conveyed via wireline or the like. Wire leads on or through the packer's mandrel 232 as in FIG. 18C or a circuit created using the metal components of the packer 230 itself can interconnect the power source to the stimulus source, such as a heating element, dispersed particles, light source, etc. associated with the packer element.

4. Light Activation

The stimulus source (e.g., 262 in FIG. 18A) can be a light source to generate light adjacent the SMP material to activate it. The generated light can thereby induce heat in the SMP material of the packer element 250 to activate it. The light source can be powered locally by a power pack or other energy source, or the light may come from a fiber optic umbilical run downhole. Fiber optics can even be embedded in the packing element 250 itself.

Rather than inducing heat, light-induced stimulation of SMP materials can be achieved by incorporation of reversible photoreactive molecular switches in the SMP material according to techniques available in the art. Light activated shape memory polymers (LASMP) are known in the art that use wavelength of light and not heat for the transition. LASMPs use photo-crosslinking at one wavelength of light. Then, light at a second wavelength reversibly cleaves the photo-crosslinked bonds so that the material switches from an elastomer to a rigid polymer. Although some light frequencies may not be able to penetrate opaque wellbore fluids, higher frequency light such as infrared or even lasers could be utilized.

5. Thermo Chemical Reactions/Change in PH

Localized thermal chemical reactions can generate heat to activate the SMP material of a packing element. In addition, a change in PH can activate the SMP material, such as circulating fluid with a desired PH level downhole or changing PH locally in the borehole by dropping a pill, releasing an alkaline substance, or other material in the borehole near the packer element 250. These changes can be created by mixing two separate chemicals at a controlled time. For example, operators can pump a chemical downhole that reacts with another chemical on/in the SMP material of the packing element or that is already present in the wellbore. In addition, the chemicals can be stored in separate chambers on the packer 230 and mixed in response to an electrical or mechanical actuation such as a burst disk, poppet valve, or the like.

6. Geothermal Heat Generation

One readily available way to provide heat and activate the SMP material of a packing element can be achieved using the geothermal heat already provided within the wellbore at the operational location. If the wellbore temperature at the setting location is less than the SMP material's transitional temperature, additional heat can be added via one of the techniques described herein. If deployed via coiled tubing, additional heated fluid can be injected to setting location of the packer to actuate the SMP material of the packing element.

The addition of geothermal heat into the tool will be a factor in any wellbore operation. In deep or extremely hot wells, cooling of the packing element may be necessary to negate premature shape change of the SMP material. If deployed via coiled tubing, colder fluids can be ran through the tool string and around the packer/brig plug tool to maintain a temperature lower than the SMP material's transition temperature. The polymers can also be engineered to react at a specific temperature or even have a slower reaction time to negate such needs.

7. Additional Forms of Activation

Moisture can affect the transformation temperature of SMP materials. When immersed in water, moisture can diffuse into the polymer and act as a plasticizer resulting in shape recovery. Accordingly, for packing elements composed of a suitable SMP material, the existing water or other fluid in the well can be used to activate the SMP material. Alternatively, operators can pump water or other fluid into the annulus or down the tubing if the water or fluid to activate the SMP material is not present. Activation via water or fluid can be a slow reaction that occurs over a period of time, which may be appropriate in some implementations.

Ultrasonic pulsing can also activate SMP materials of packing elements. The ultrasound can be introduced by an ultrasound source. The generated ultrasound can produce a hysteresis effect in the SMP material of the packing element and generate heat internally therein. Attaching a radiation source such as Uranium to a setting or retrieval tool can also be used to activate the SMP material of a packing element.

F. Inflatable Element on Isolation Tool Having Shape Memory Polymer

In addition to sleeve and cup packing elements discussed previously, Shape Memory Polymer (SMP) materials can be used in inflatable tools, such as packers and bridge plugs, as part of the inflatable element of the tool. In different arrangements discussed below, the SMP material can be used as a tubular stent to expand the bladder/rib bundle or as the inflatable bladder (inner tube) of the inflatable element. In each instance, the SMP material can be formed in various permanent and temporary shapes and can be stimulated using light, magnetic field, thermo chemical, heat, radiation, and other technique disclosed herein.

1. SMP Stent Internal to Inflatable Bladder

Figure 19A:
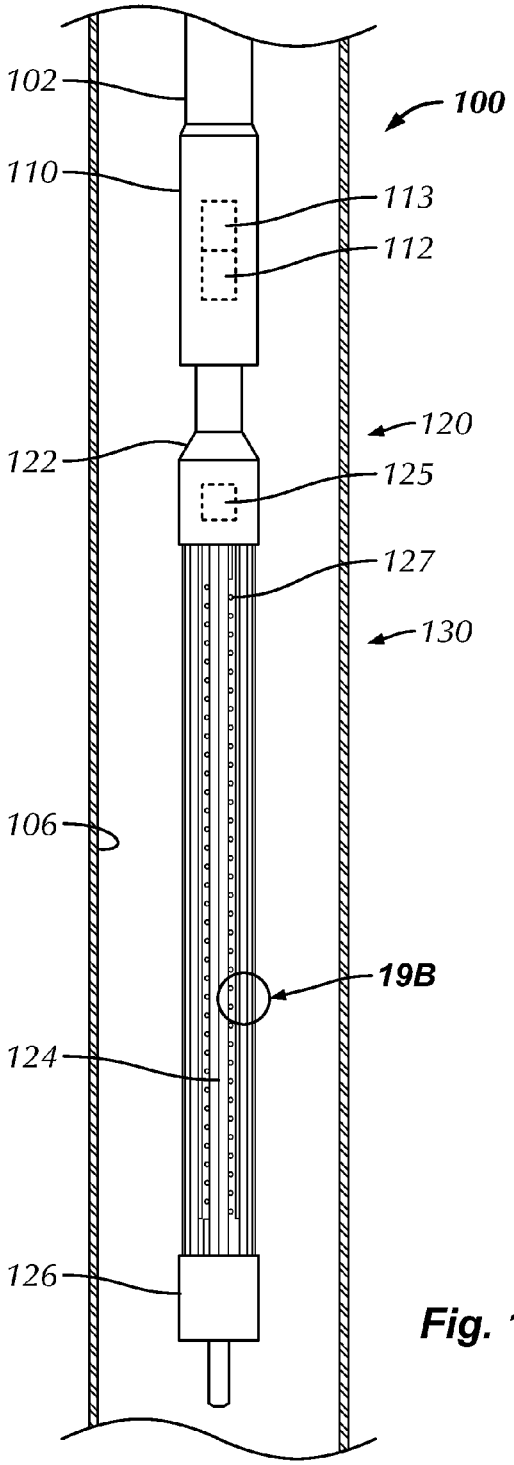
FIGS. 19A-19C illustrate a partial cross-section and a detailed view of a downhole tool having a stent composed of an SMP material disposed internally in an elastomer bladder of an inflatable packer element.
Figure 19B:
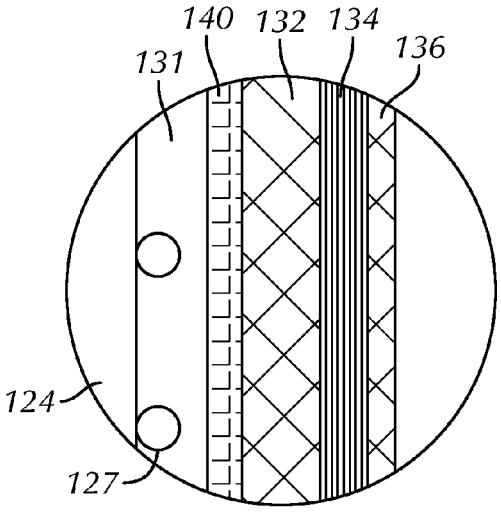

FIGS. 19A-19B illustrate a partial cross-section and a detailed view of a downhole tool 100 having a stent 140 incorporated into an inflatable element 130. The downhole tool 100 deploys in a casing or tubular 106 using coiled tubing or tubing string 102 and has portion of a deployment tool or bottom hole sub-assembly 110 connected thereto. The downhole tool 100 also has an isolation tool 120, which can be an inflatable packer or plug. The isolation tool 120 has an upper sub-assembly 122, a mandrel 124, and a lower sliding sub 126. The upper sub-assembly 122 connects to the bottom hole sub-assembly 110, which in turn suspends from the coil tubing or tubing string 102.

The upper sub-assembly 122 houses an inflation mechanism 125 having valves, sleeves, and the like used to open and close the flow of fluid from the coil tubing or tubing string 102 into the chamber 131 of the inflatable element to inflate it to the surrounding sidewall. The components of such a mechanism 125 are well known in the art and are not discussed in detail here.

The sub-assembly or deployment tool 110 has an SMP activation device or activator 112 that provides or initiates the stimulus needed to transition the SMP components of the tool 100. Further details of the activator 112 are discussed below. The sub-assembly 110 also has an inflator 113 that inflates the inflatable element 130 of the tool 100. The components of such an inflator 113 are well known in the art and are not discussed in detail here. In general, the inflator 113 has mechanisms that fill the chamber of the inflatable element 130 with fluid (e.g., water, drilling fluid, cement, etc.) to inflate the inflatable element 130 to the inflated state and engage the surrounding sidewall. Of course, either one or both of the activator 112 and inflator 113 can be incorporated into the isolation tool 120 or can be part of some other tool.

A conveyance member 127 connects from the activation device 125 and disposes along the length of the mandrel 124. The isolation element 130 is disposed about the mandrel 124 adjacent the conveyance member 127. As shown in the detail of FIG. 19B, the isolation element 130 includes a stent 140, a bladder 132, a reinforcing rib bundle 134, and an external rubber cover 136. In the present arrangement, the stent 140 is composed of SMP material and is disposed internal to the rubber bladder 132. In other arrangements, the stent 140 may not be used, the bladder 132 may be composed of SMP material, the rib bundle 134 may be composed of SMP material, or any combination thereof.

Depending on the type of stimulus, the conveyance member 127 can be a coil of a heating element disposed about the mandrel 124. In this instance, the activation device 112 can include a hydroelectric generator or alternator powered by injection fluid passing through the assembly 110 from the coil tubing or string 102. Alternatively, the conveyance member 127 can be a coil for electric power or electromagnetic field. In this instance, the activation device 112 can include a power pack actuated hydraulically, mechanically, or by Radio Frequency Identification Device (RFID) deployed down the tubing or string 102 from the surface. The activation device 112 provides power for heating element or electric-magnetic field. Alternatively, the activation device 112 may contain chambers for separating and mixing thermo-chemicals to induce an exothermic reaction to stimulate the SMP material of stent 140.

Figure 19C:
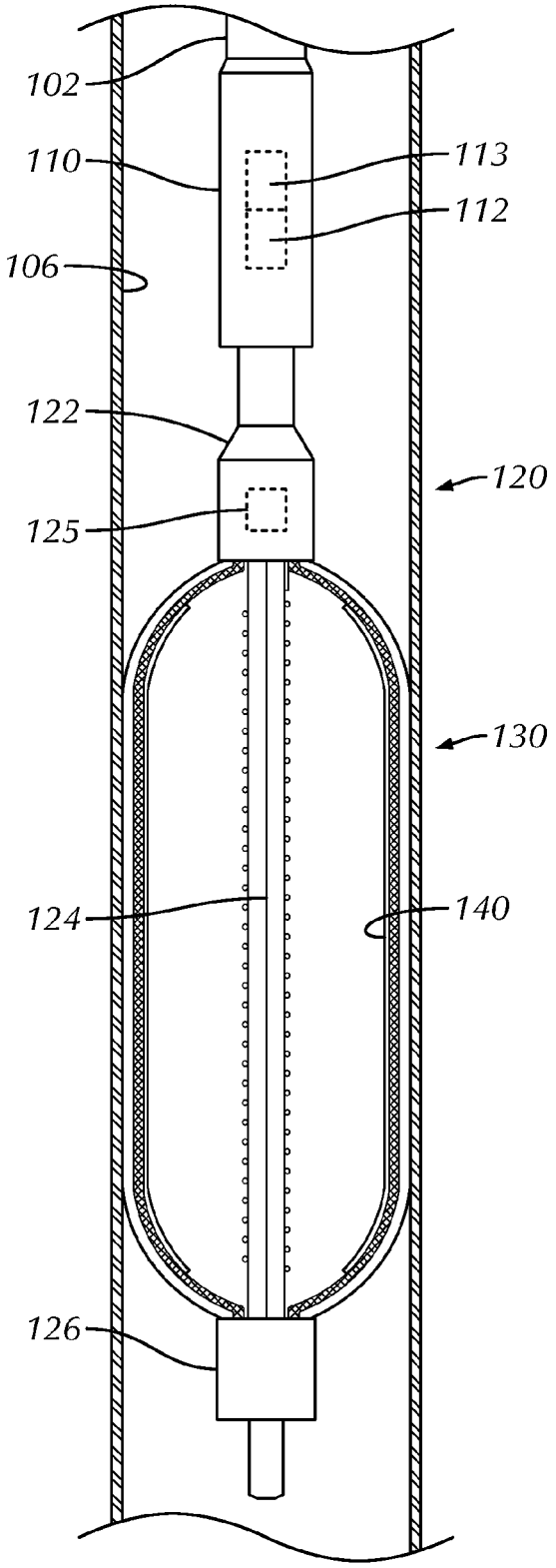

When formed, the SMP stent 140 has an initial shape that is a fully expanded tubular. Once formed, the stent 140 is programmed into a smaller tube with its excess material folded around its circumference. The stent 140 in this programmed tubular shape is then installed inside the rubber bladder 132 of the inflatable element 130 and is covered by the rib bundle 134 and cover 136. When the inflatable element 130 is ready to be inflated, the bladder 132 is expanded with fluid using conventional inflation techniques for inflatable packers and the like. Concurrent or subsequent to the inflation, the SMP stent 140 is stimulated to return to its original expanded tubular form to reinforce the bladder 132 internally as shown in FIG. 19C.

2. SMP Stent External to Inflatable Bladder

Figure 20A:
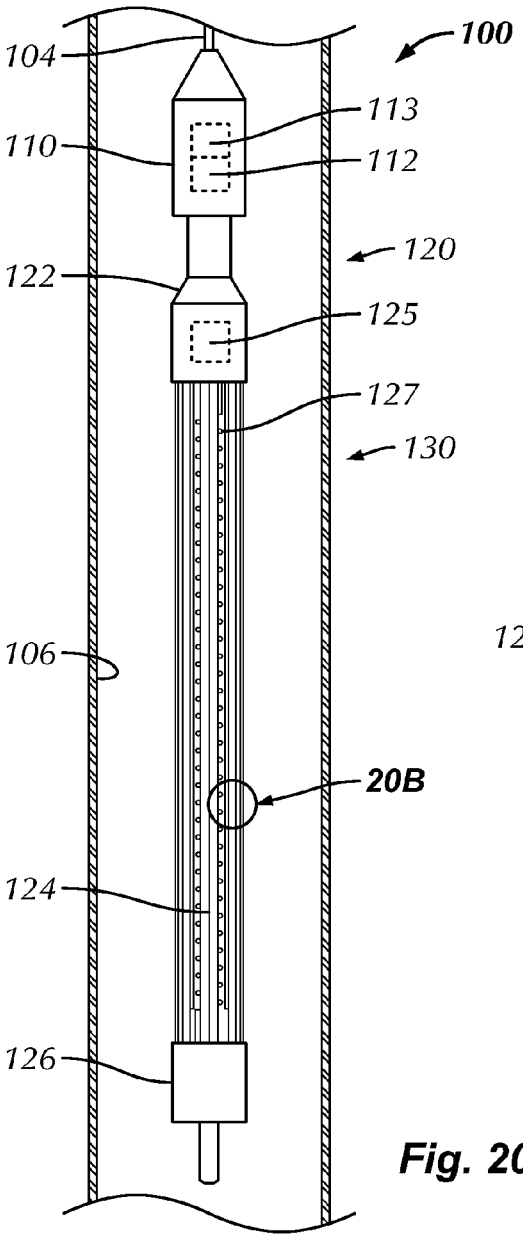
FIGS. 20A-20B illustrate a partial cross-section and a detailed view of a downhole tool having a stent composed of an SMP material and disposed externally outside an elastomer bladder of an inflatable packer element.
Figure 20B:
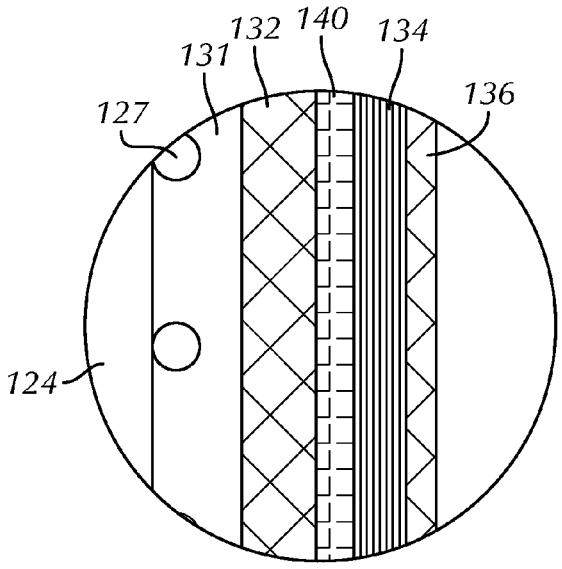

FIGS. 20A-20B shows an alternative arrangement in which the stent 140 of SMP material is disposed externally outside the rubber bladder 132 of the inflatable element 130. As shown in the detail of FIG. 20B, the stent 140 positions between the rubber bladder 132 and the rib bundle 134 of the element 130. The stent 140 is stimulated first to push the rib bundle 134 to the inflated position. The bladder 132 is then inflated inside the expanded stent 140 and rib bundle 134. This allows the bladder 132 to expand more uniformly without the constraint of the rib bundle 134 and rubber covers 136. This arrangement also shows the tool 100 deployed using a wireline 104 as another alternative.

3. SMP Inflatable Bladder

Figure 21A:
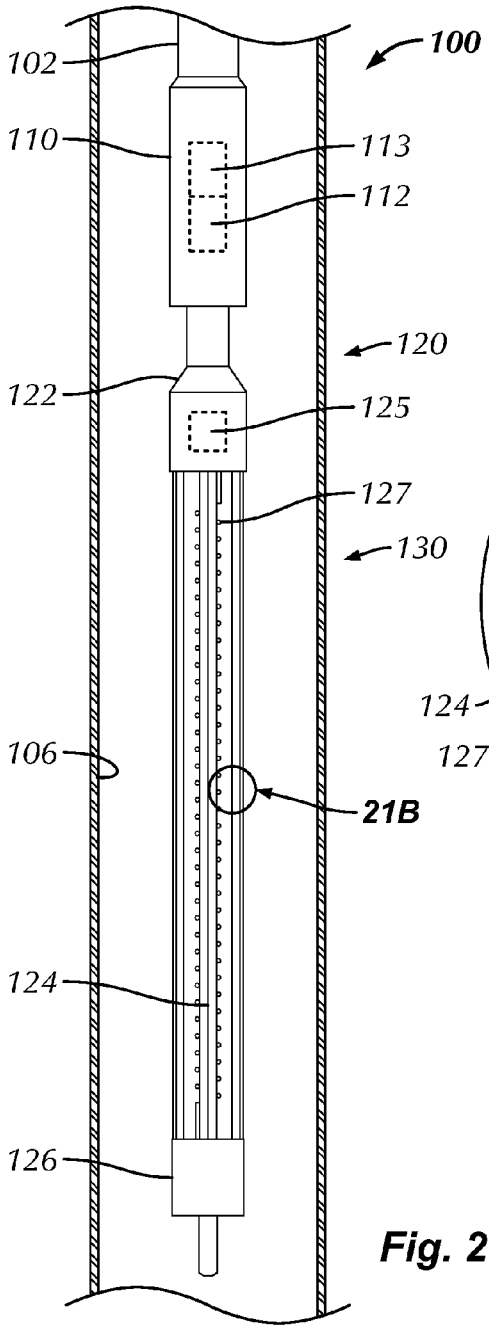
FIGS. 21A-21B illustrate a partial cross-section and a detailed view of a downhole tool having a bladder composed of an SMP material.
Figure 21B:
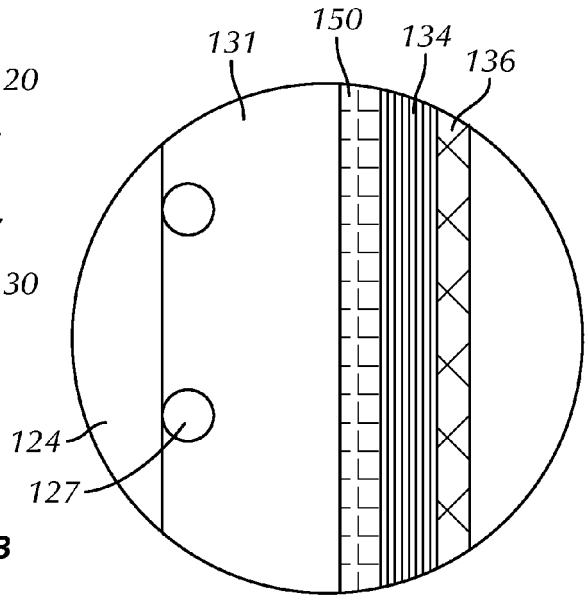

As an alternative to using a stent of SMP material in conjunction with a bladder, the inflatable element 130 can use a bladder 150 composed of SMP material. As shown in FIGS. 21A-21B, the inflatable element 130 includes a bladder 150, a rib bundle 134, and cover 136. The bladder 150 is composed of SMP material. The bladder 150 has two different program shapes and only one original shape. The bladder's original shape is a pill-like cylinder or any other shape that best resembles the inflated shape for a bladder. The bladder 150 is programmed to fit inside the inflatable element 130 by having excess material fold and compress around its circumference, along its length, or both to form a run-in shape that is cylindrical. When the inflatable element 130 is ready to be inflated downhole, the SMP material is stimulated to expand to its original cylindrical pill shape (or any other ideal shape of the inflated bladder) while contained between where the rib bundle 134 and rubber cover(s) 136 want it, or the SMP material will take shape to the inflated position. Additional pressure from injection fluid easily expands the bladder to its original pill shape, creating a positive pack-off force with the element 130 against the surrounding casing or tubing 106.

4. SMP Rib Bundle

The rib bundle 134 of the inflatable element 130 can also be composed of an SMP material. The rib bundle 134 is typically a structure of overfolded strips running longitudinally along the inflatable element 130. As the element 130 inflates, these strips unfold from one another and expand outward with the bladder 150 to provide reinforcement. As such, the rib bundle 134 can be composed of several such strips of SMP material with a programmed shape to best fit inside the casing or tubing 106. For example, each rib of the bundle 134 can define squared edges so that a majority of the central portion defines a cylinder for contacting the surrounding sidewall 106. In addition, the bladder 150 composed of SMP material can also replace the rib bundle 134 entirely, especially if there is adequate strength in the bladder 150 alone to reinforce its shape and structure.

5. Various Shapes for SMP Stents, Bladders, and Rib Bundles

In FIGS. 22A-22B, a temporary, programmed shape of an SMP inflation element 160A composed of SMP material is shown. This inflation element 160A can be a stent, a bladder, a rib bundle, or other component of an inflatable packing element as discussed previously. In this programmed shape, the inflation element 160A is used for the run-in position of the tool, and has excess circumference folded axially along the length of the element 160A to form the programmed shape. When activated, the element 160A reverts to its permanent shape shown in FIG. 22C in which it has an expanded cylindrical shape.

Figures 23A, 23B:
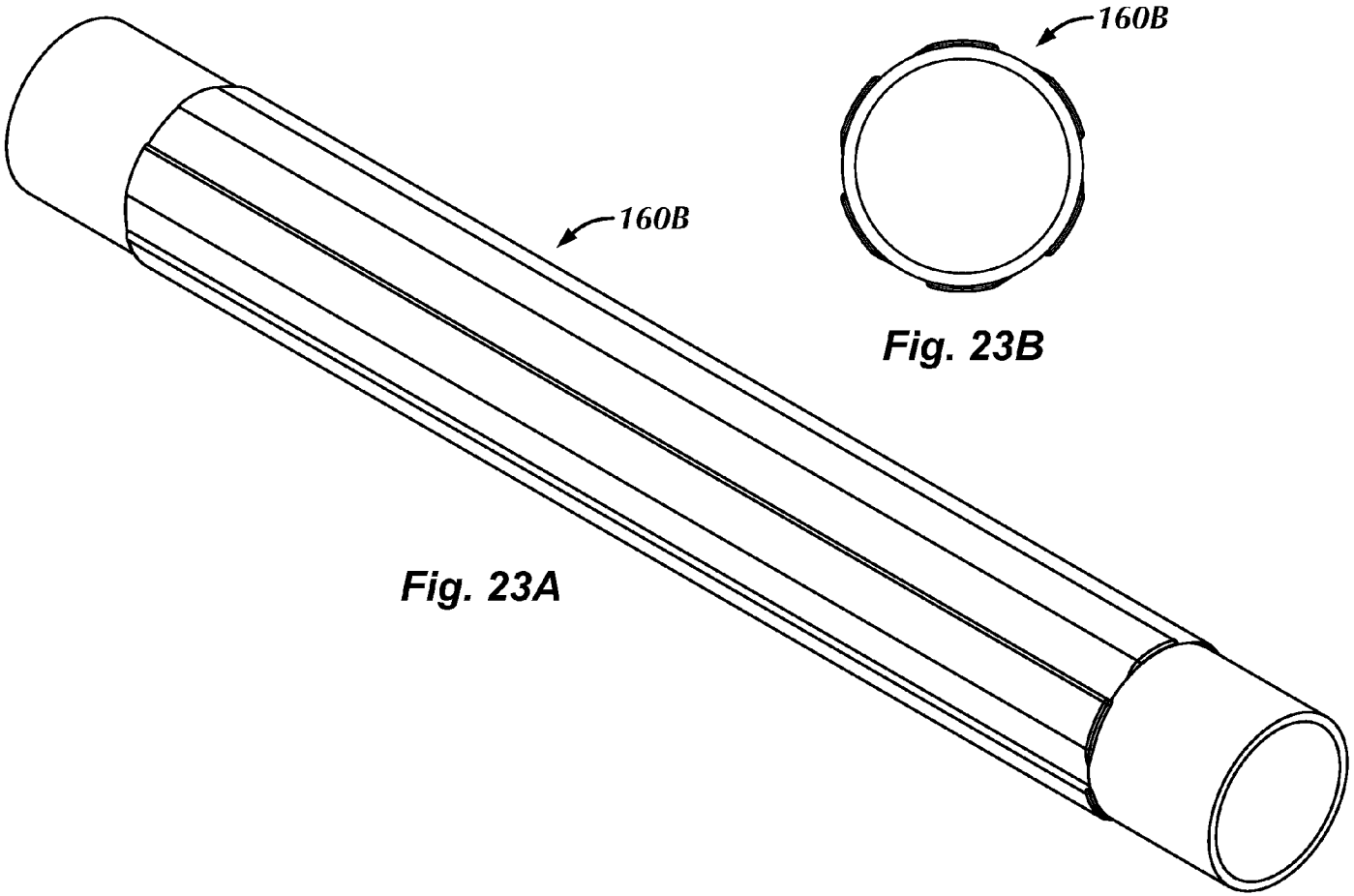
Figure 23C:
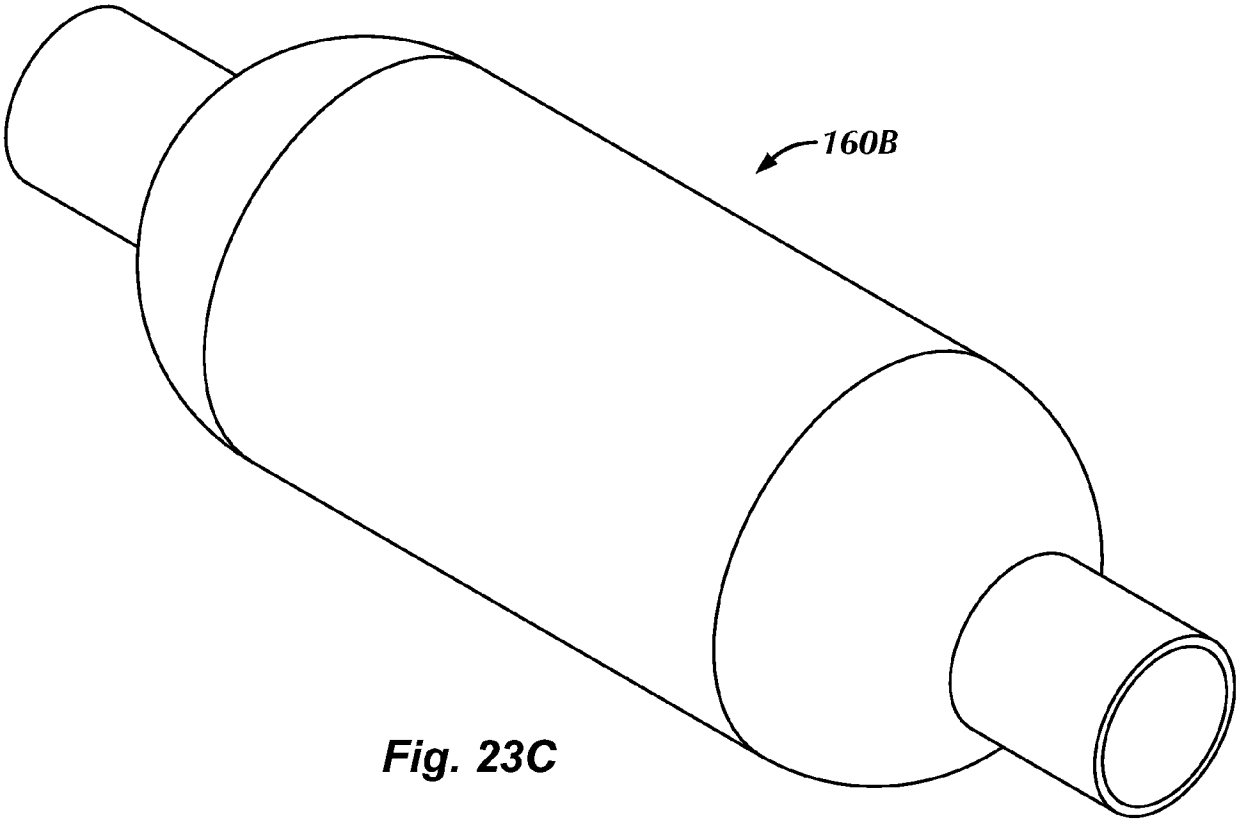

In FIGS. 23A-23B, a temporary, programmed shape of an SMP inflation element 160B (i.e., stent, bladder, or rib bundle) is shown for the run-in position. The SMP inflation element 160B has excess circumference folded axially along the length of the element, but the element's ends are kept cylindrical. When activated as shown in FIG. 23C, the permanent shape of the element 160B for the set position has an expanded cylindrical center portion with the ends maintaining a smaller cylindrical shape (or other ideal inflated bladder shape) for fitting to sub-assemblies of a downhole tool as described previously.

Figure 24A:
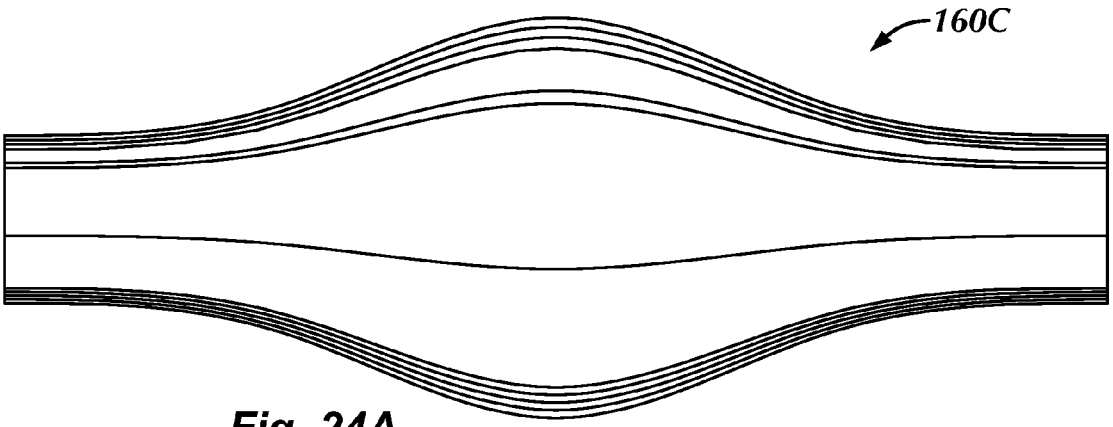
Figure 24B:
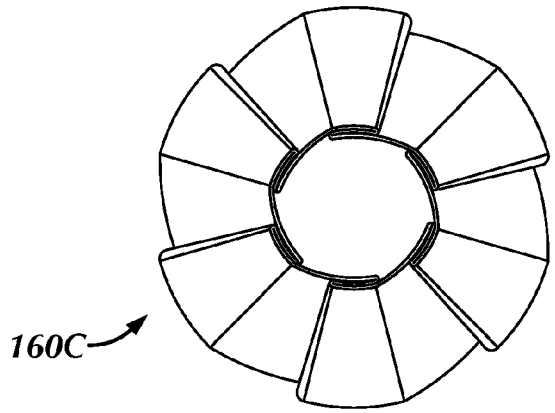
Figure 24C:
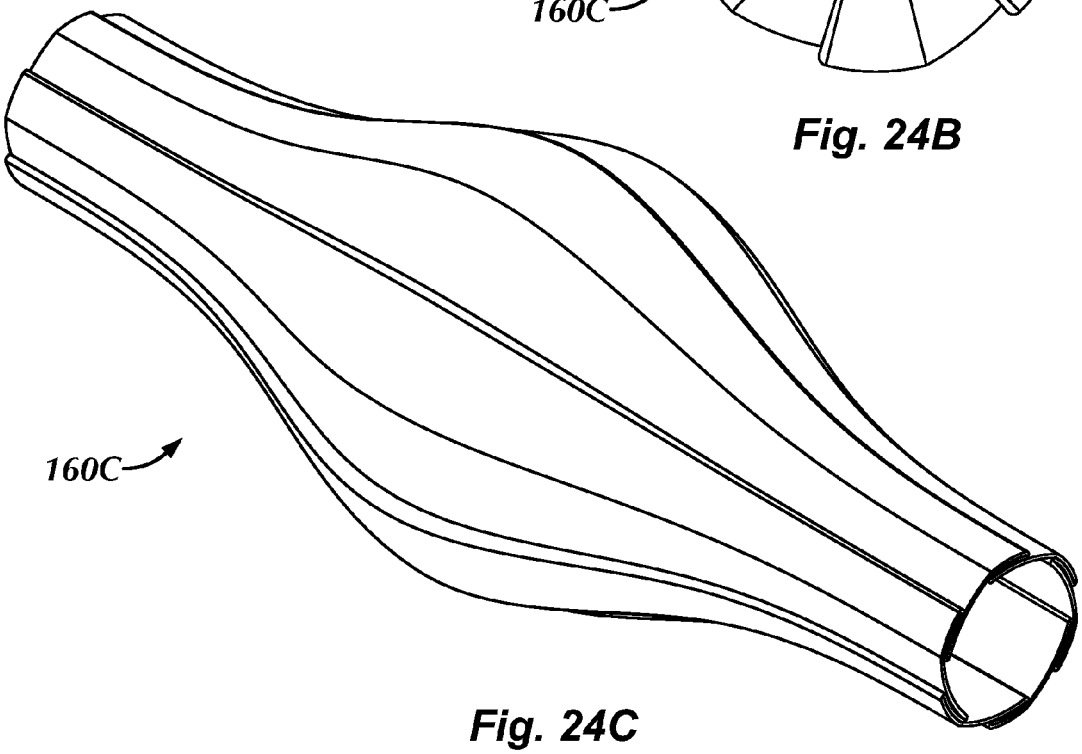

In FIGS. 24A-24C, a programmed, temporary shape of an SMP inflation element 160C (i.e., stent, bladder, or rib bundle) is shown for the run-in state. The SMP inflation element 160C has excess circumference folded longitudinally along the length of the element 160C and has a central portion that bulges slightly. Although not shown, this element 160C may have a permanent shape for the set state similar to that shown in FIG. 23C, although the transition to the ends may be more gradual.

Figure 25A:
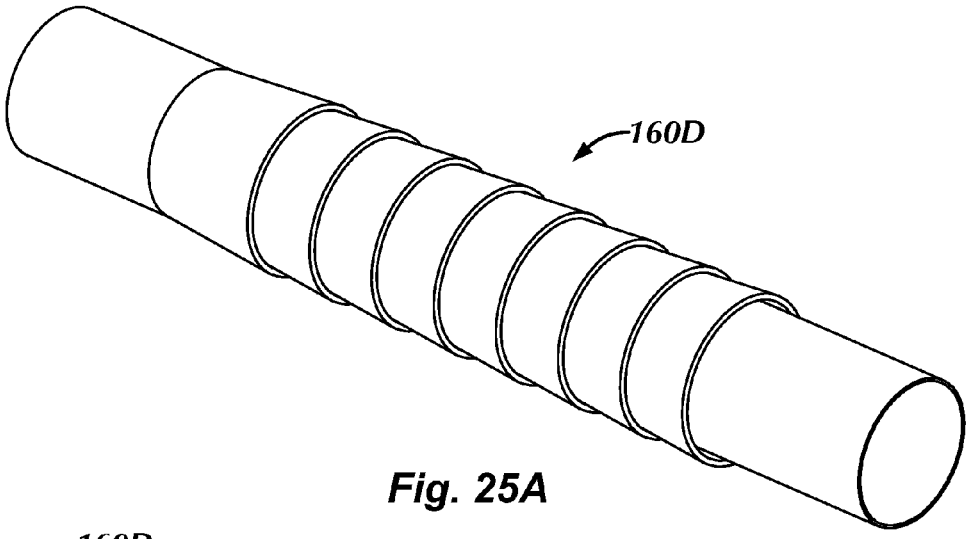
Figure 25B:
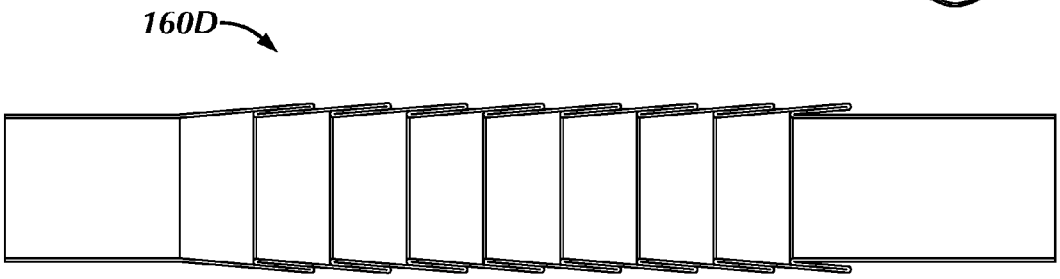
Figure 25C:
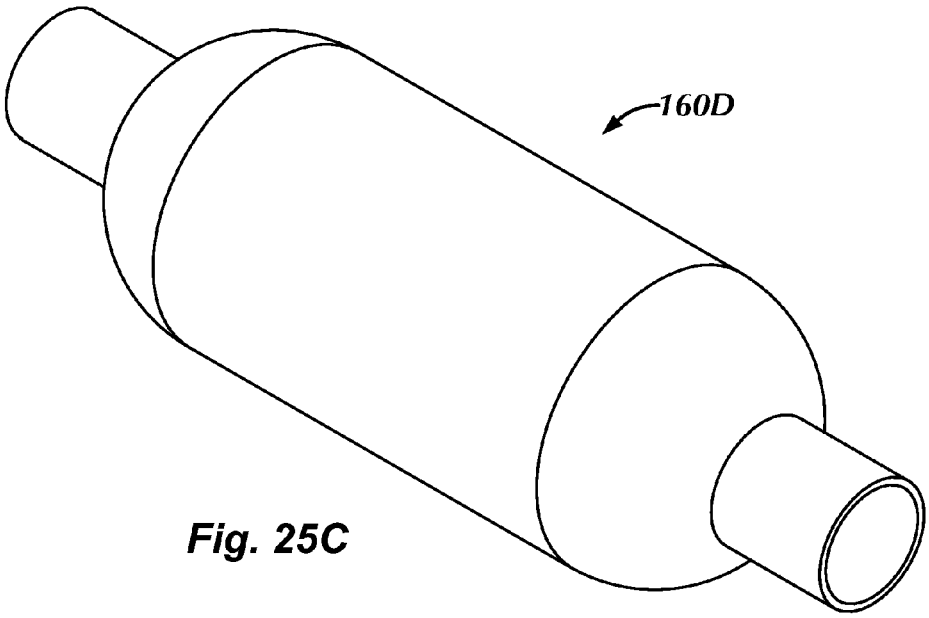

In FIGS. 25A-25B, a programmed, temporary shape of an SMP inflation element 160D (i.e., stent, bladder, or rib bundle) is shown for the run-in position. This SMP inflation element 160D has excess circumference folded radially along the length of the element 160D, but the element's ends remain unfolded. As shown activated in FIG. 25C, the permanent shape of the element 160D for the set position is similar to that shown in FIG. 23C.

SMP inflation elements (i.e., stents, bladders, or rib bundles) can use these and other forms of folding and bulging depending on the implementation. For example, the permanent or programmed shapes described above can be used individually or in combination with one another to suit a given implementation. In addition, additional deformation can be performed to these elements 160 to program their temporary shape to better fit the tool on which it is to be used. As hinted above, each of the above elements 160 of SMP material can be used as an individual component or combined as a composite with the rubber elements, such as the bladder or cover, of the isolation packer on the tool.

6. Various Shapes for Internal, External, and Embedded SMP Stents

Figure 26A:
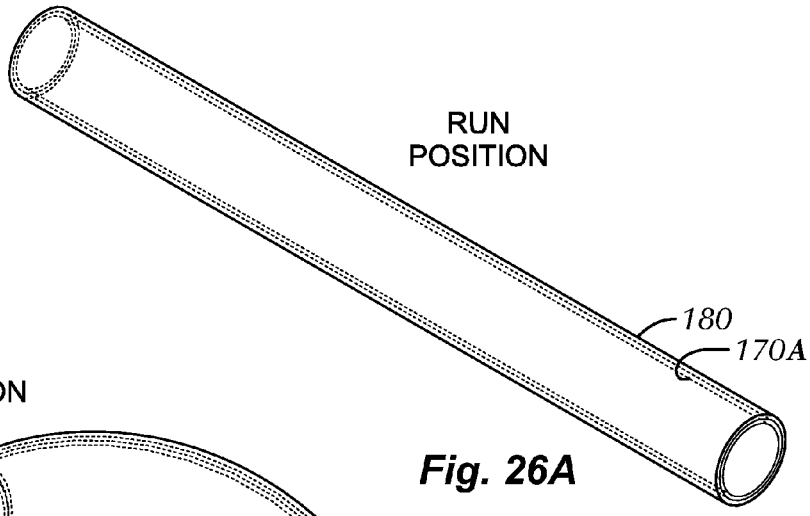
FIGS. 26A-26C show an internal stent in the shape of a bladder in which it positions.
Figure 26B:
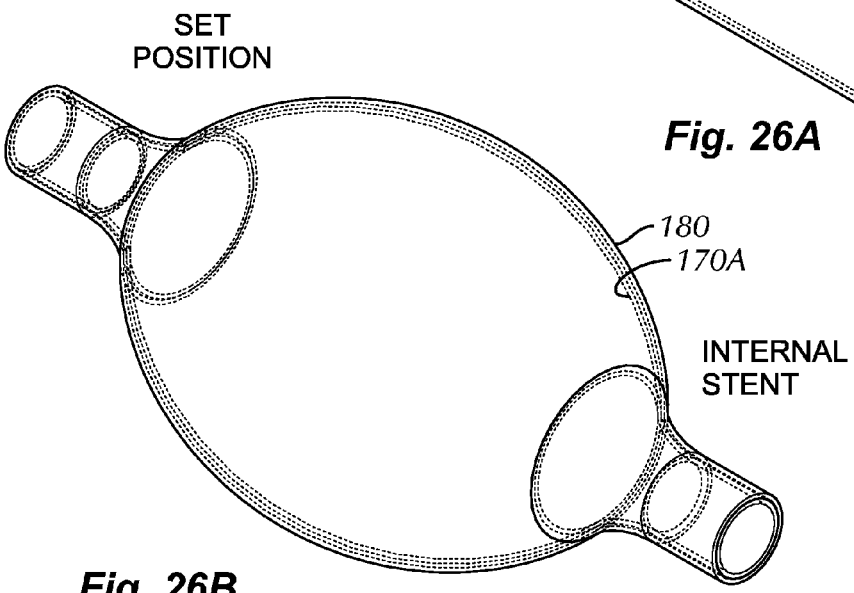
Figure 26C:
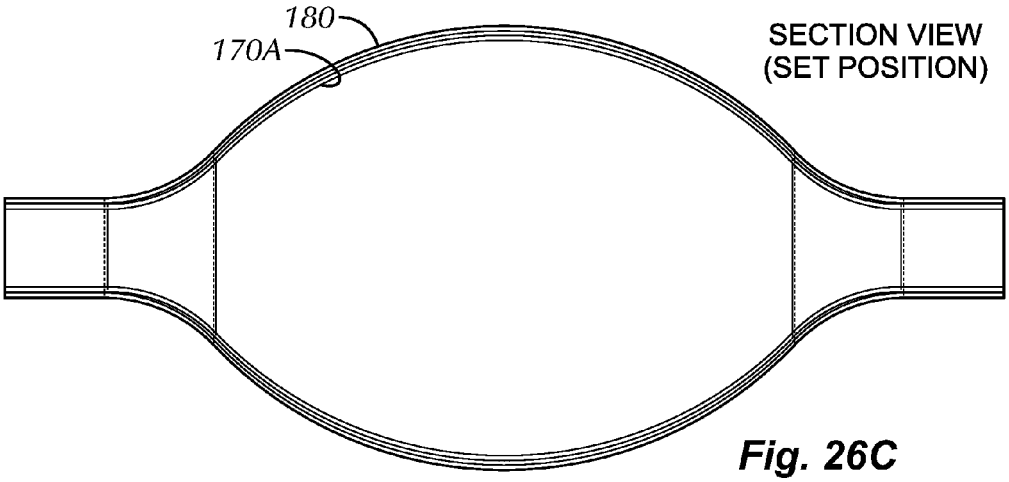

Along the same lines as discussed above with reference to FIGS. 22A through 25C, the various stents used in the inflatable packer tool can have additional shapes and can be used internal to the bladder, external to the bladder, or embedded in the bladder material. In FIG. 26A, a stent 170A is disposed internally to a bladder 180 and has a run-in shape that is cylindrical. When activated to the set position as shown in FIGS. 26B-C, the stent 170A has a permanent shape that is centrally expanded, thereby pre-expanding the surrounding bladder 180 and reducing the potential for undesirable Z-folding. This stent 170A could also be configured external to the bladder 180.

Figure 27A:
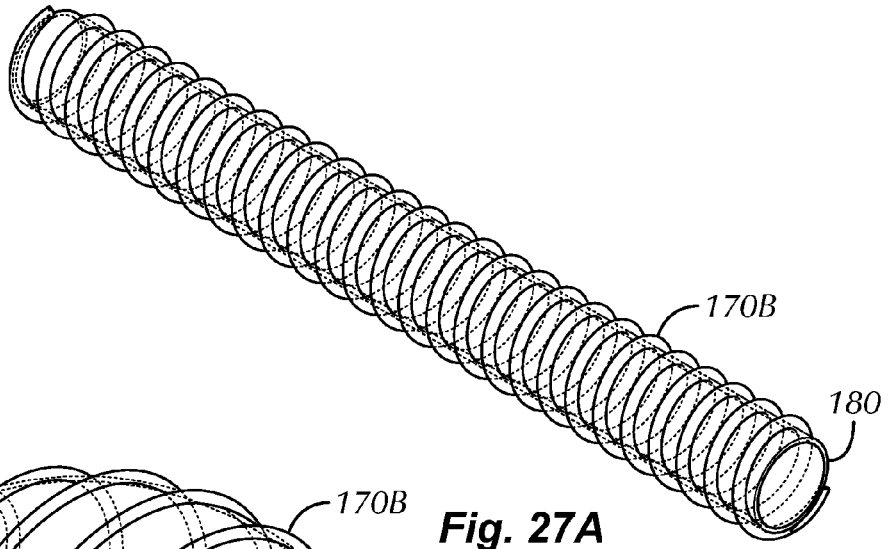
FIGS. 27A-27C show an external stent in the shape of a spring that positions externally to the bladder.
Figure 27B:
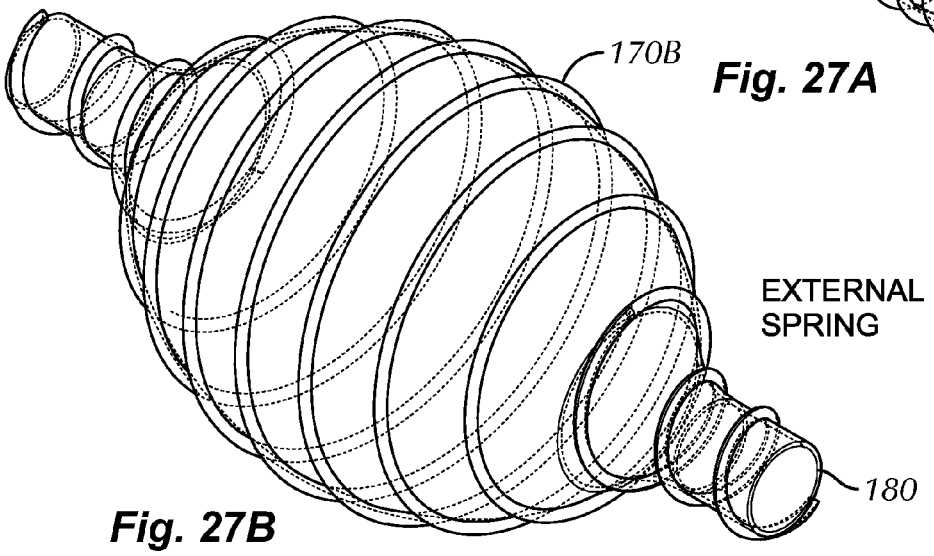
Figure 27C:
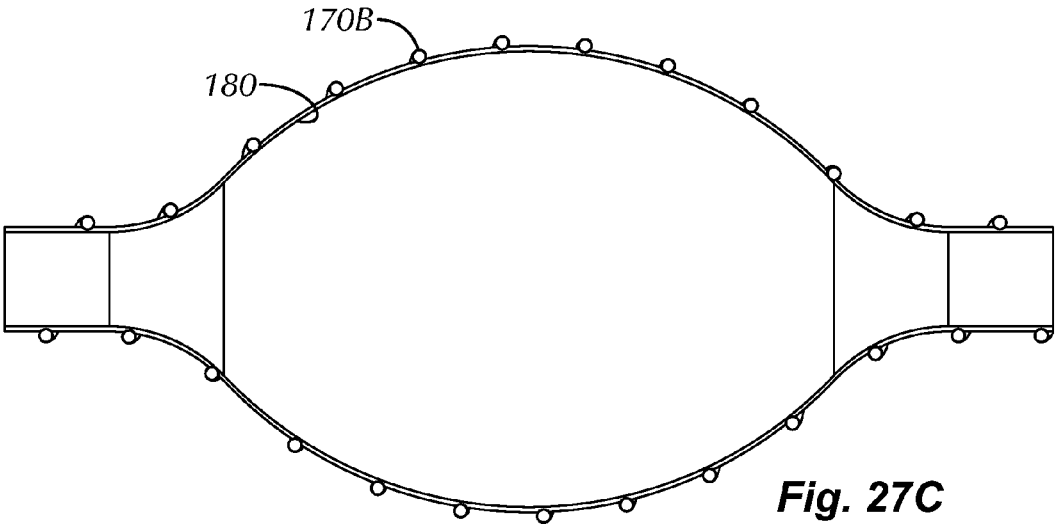

In FIG. 27A, a stent 170B in the shape of a spring positions externally to the bladder 180 and has a generally cylindrical, spiral shape. When activated to the set position as shown in FIGS. 27B-C, the spring-shaped stent 170B has a permanent shape in which it is centrally expanded and can be used to expand the rib bundle and cover outside of the bladder.

Figure 28A:
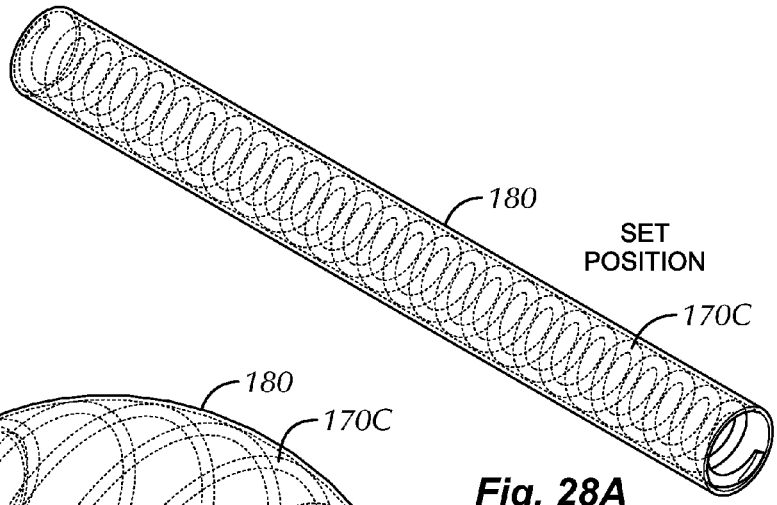
FIGS. 28A-28C show an internal stent in the shape of a spring that positions internally to the bladder.
Figure 28B:
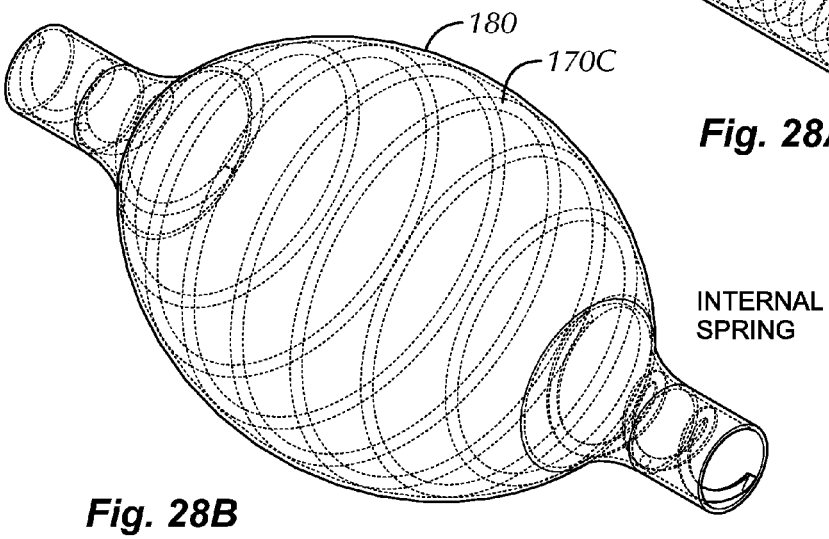
Figure 28C:
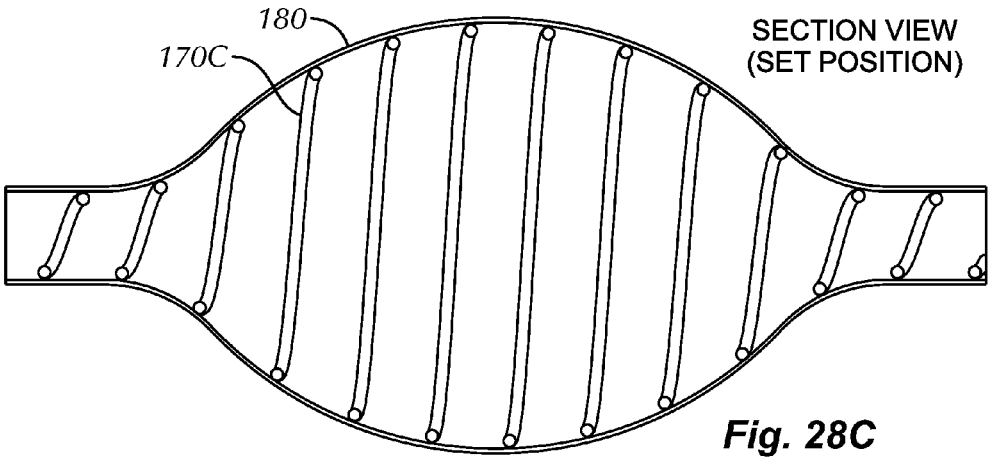

As shown in FIGS. 28A-28C, a similar stent 170C in the shape of a spring can positions internally to the bladder 180. The spring shaped stents 170B-C could also be embedded in the bladder material.

Figure 29A:
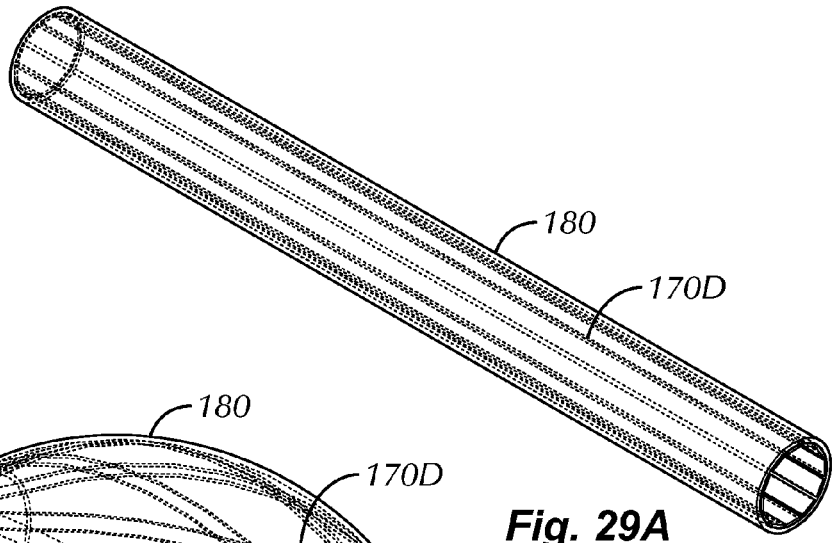
FIGS. 29A-29C show an internal stent in the shape of individual slats that position internally to the bladder.
Figure 29B:
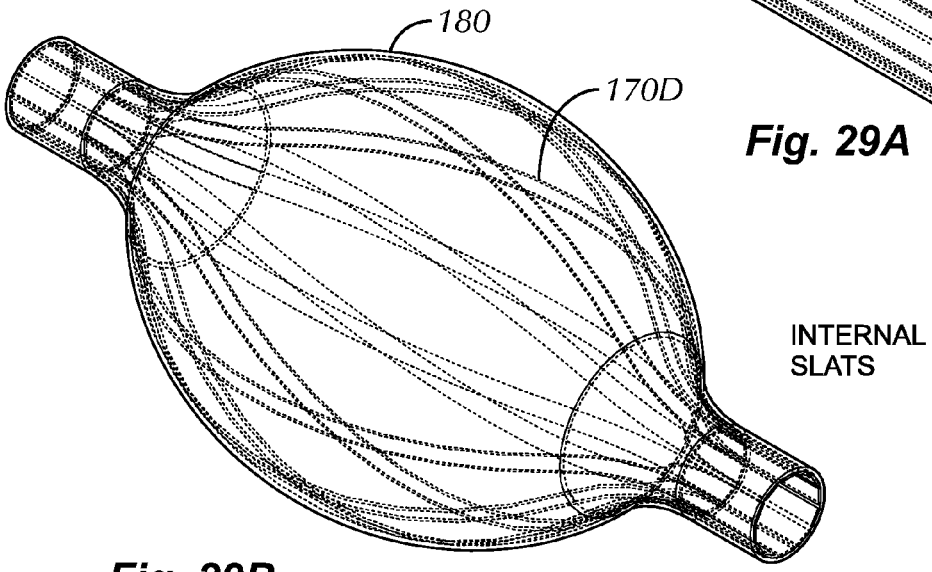
Figure 29C:
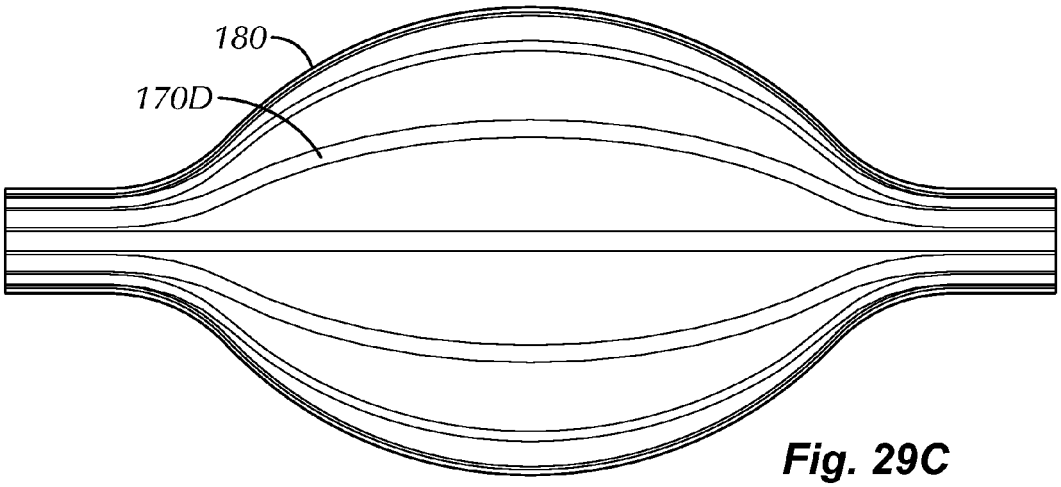

In FIG. 29A, a stent 170D in the shape of individual slats position internally to the bladder 180. In their programmed position of FIG. 29A, these slats of the stent 170D are straight and position around the cylindrical interior of the bladder 180. In their permanent state as shown in FIGS. 29B-C, the slats of the stent 170D bend at their centers to bulge the central portion of the bladder 180. The slats of the stent 170D could also be employed externally to the bladder 180 or embedded in the bladder's material itself.

Figure 30A:
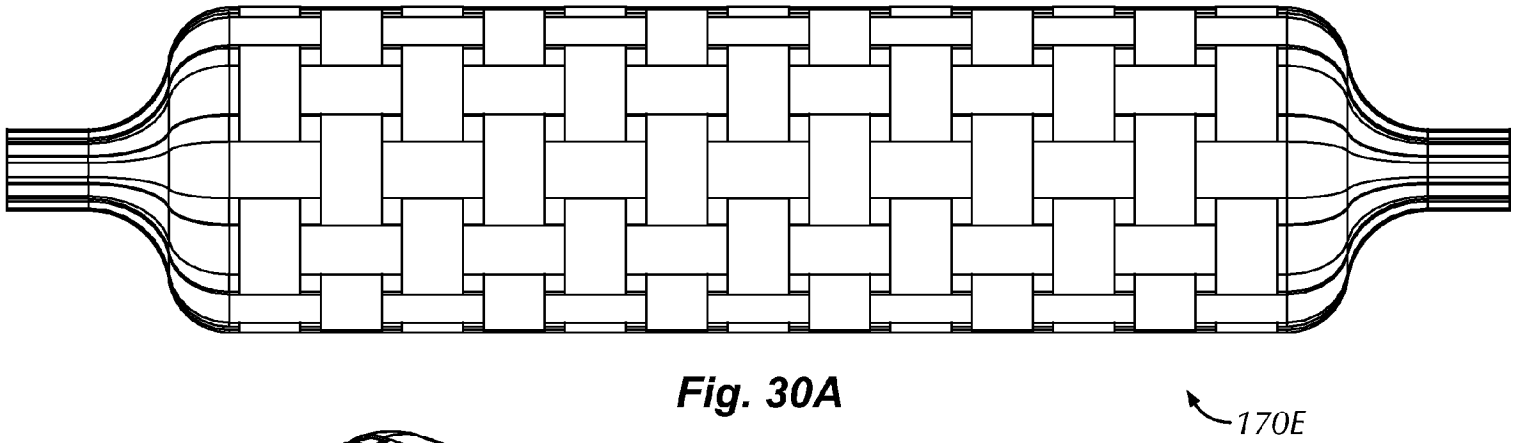
FIGS. 30A-30B show an external stent having a weave of slats.
Figure 30B:
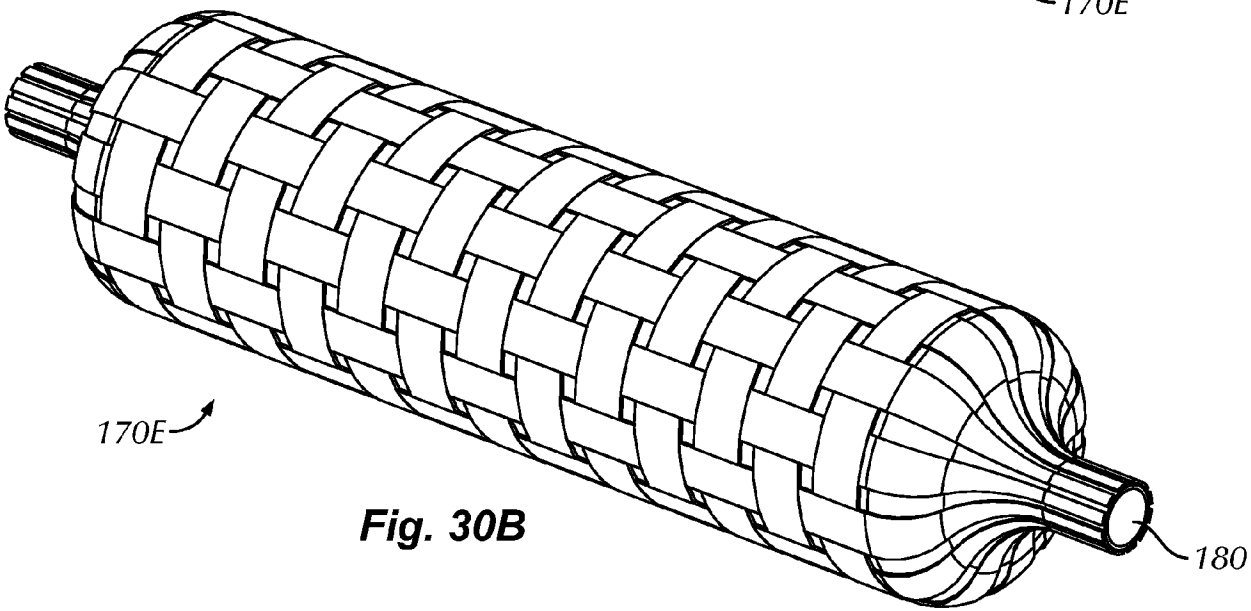

FIGS. 30A-30B show an external stent 170E in the shape of interlaced lattice that positions externally to the bladder 180. As shown, the stent 170E has it permanent shape for setting. When programmed into a temporary shape, the stent 170E would have a more cylindrical profile for running downhole. This stent 170E could also be employed internally to the bladder 180 or embedded in the bladder's material.

The weave of the bladder 170E can also be diagonal using different cross-sectional shapes. The weave may also have layers that are not interwoven. For example, a layer of slats that run circumferentially around the bladder 170E can be used along with a top layer of slats that run axially or diagonally along the bladder 170E.

G. Programming Process

1. Hydroforming

Figure 31:
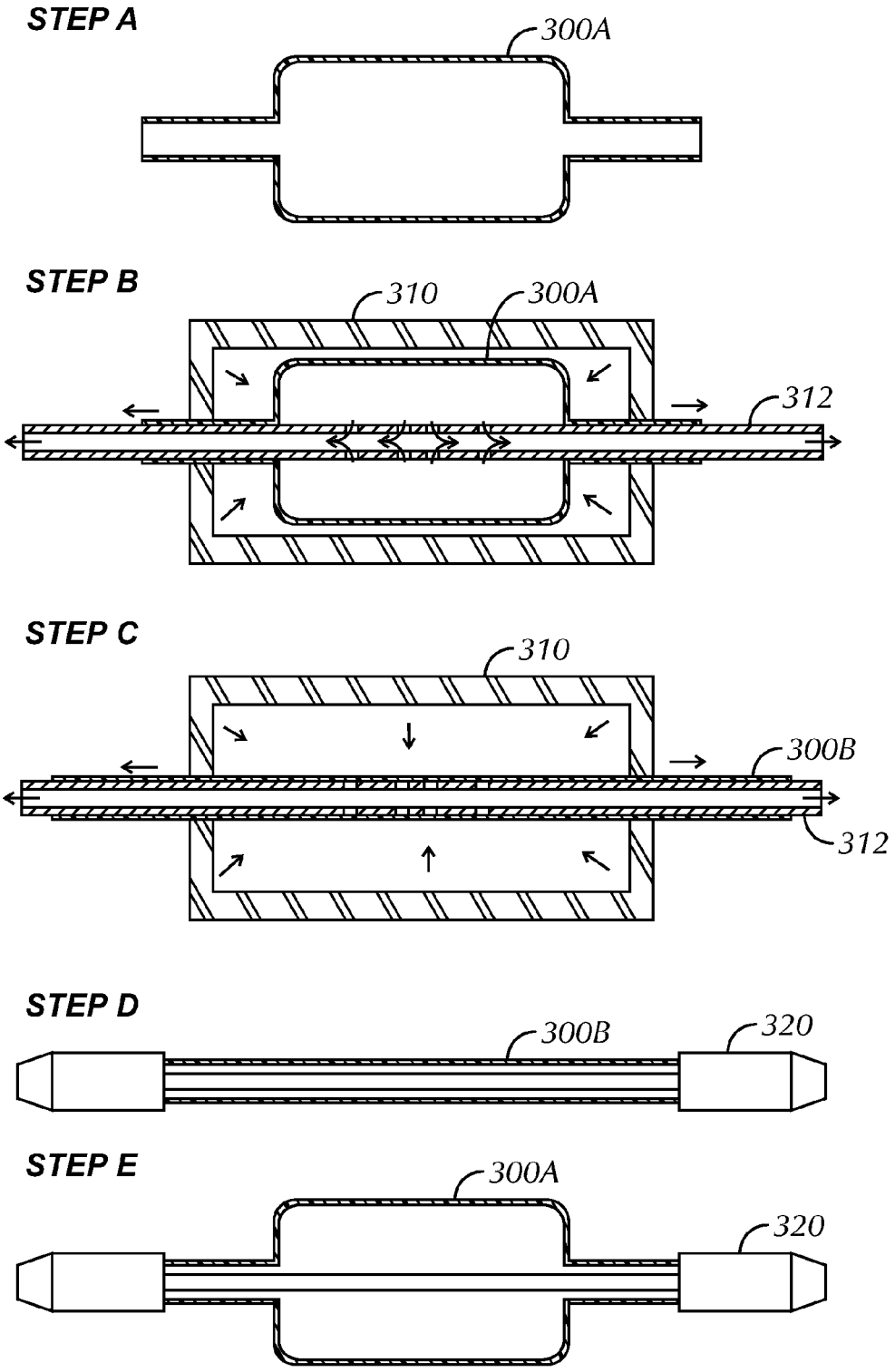
FIG. 31 shows a hydroforming programming process for an inflatable element of a tool.

FIG. 31 briefly shows a programming process for a packing element having SMP material for used on a downhole isolation tool, such as a packer or plug. In this example, the tool is an inflatable packer 320, and the SMP packing element is an inflatable bladder 300 composed of SMP material, although it could be a stent or the like. Initially, the inflatable bladder 300A is formed of the SMP material in its permanent shape, which is its set state, using molding and forming techniques known in the art. As shown in Step A, the bladder 300A in its permanent shape has a cylindrical center with a greater diameter than the cylindrical ends and has squared off edges as described previously.

In programming steps, various processes of folding, pressure, stress, vacuum, heating, and the like are used to program the inflatable bladder 300B into its programmed shape (Steps B-C). For example, the bladder 300A positions in a pressure vessel 310 for hydroforming the bladder 300A during these programming steps. A pipe 312 may position in the bladder 300A to draw a vacuum and decrease the overall diameter.

Ultimately, the bladder 300B in its programmed shape is a thin cylinder intended to fit closely to the mandrel of the inflatable packer during run-in. The bladder 300B is then affixed to the mandrel of an inflatable packer 320 in this programmed shape so it can be run downhole (Step D). When activated by the particular stimulus (e.g., heat) suited for the SMP material, the bladder 300A reverts back to its permanent shape with the expanded cylindrical center portion and squared off edges (Step E). Concurrent or subsequent to its activation, the bladder 300A can be filled with fluid to inflate it to its sealing capacity. In this way, the SMP bladder 300A can avoid some of the problems associated with folding found in conventional inflatable bladders.

Other programming processes can also be used to program the bladder 300 into its programmed shape. In addition to hydroforming, the programming processes include mechanical folding, pressure forming, vacuum forming, extrusion forming, clamp-die forming, and the like. Some of these are described below.

2. Clamp-Die Forming

Figure 32:
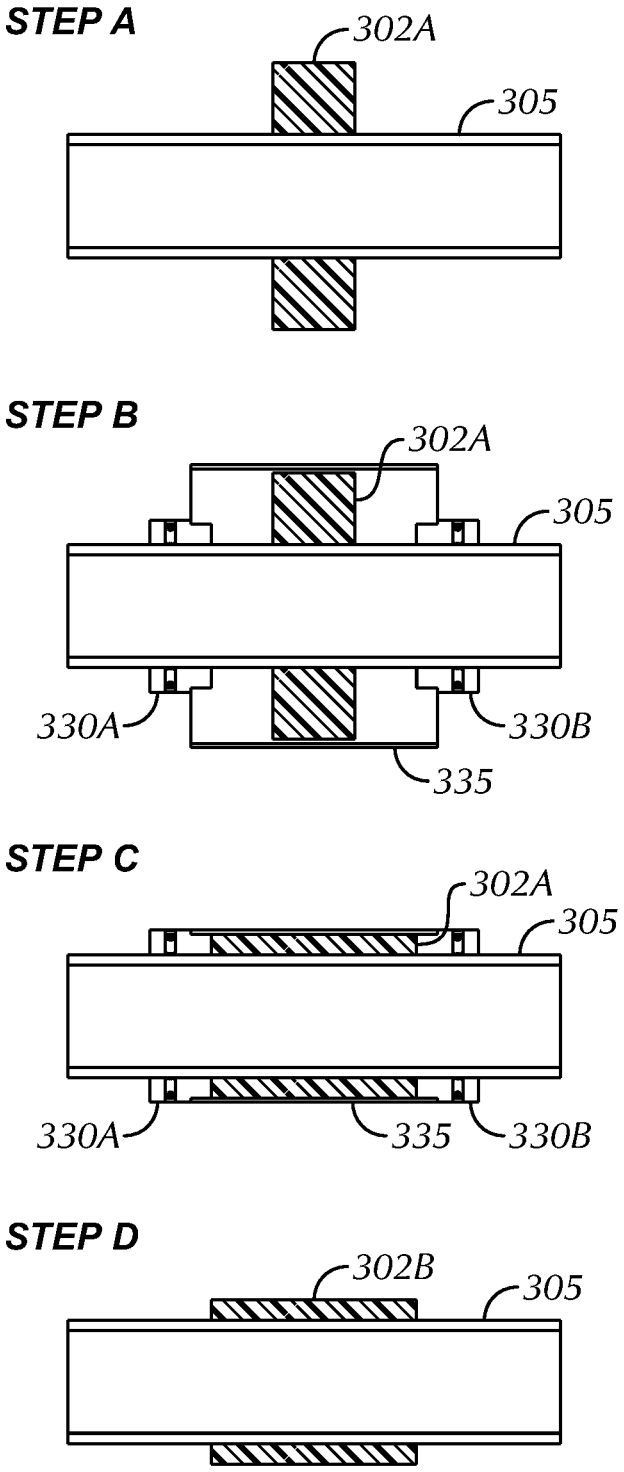
FIG. 32 shows a clamp-die programming process for a packing element of a tool.

FIG. 32 shows a clamp-die programming process for a packing element composed of an SMP material. As shown, a cylindrical sleeve 302A made of SMP is programmed from an original larger diameter to a smaller final diameter by a clamp-die forming process. In this process, the SMP material is molded into a cylindrical sleeve 302A, which can be a "set" shape for a packing element.

The molded sleeve 302A positions on a mandrel 305 with the appropriate diameter for a given application (Step A), and dies 330A-B attach to the mandrel on both sides of the molded sleeve 302A (Step B). These dies 330A-B can be attached to the mandrel 305 by screws as shown or other feasible means. Once the dies 330A-B are positioned, a band clamp fixture 335 positions over the molded sleeve 302A. This fixture 335 has a torque screw mechanism, crank mechanism, or hydraulic force mechanism (not shown) or the like to reduce the diameter of the band clamp to tighten the fixture 335 around the sleeve 302A.

Before tightening the fixture 335, the assembly is heated in an oven to bring the SMP material of the sleeve 302A above its transition temperature. When this temperature is reached, the band clamp fixture 335 is tightened to reduce its diameter and compress the molded sleeve 302A into a smaller diameter for a "run-in" shape of a compressed sleeve 302B (Step C). Once formed, the assembly is removed from the oven and cooled to allow the SMP material of the compressed sleeve 302B to retain its new compressed shape. Then, the fixture 335 and dies 330A-B are removed (Step D). Ultimately, when this mandrel 305 can be run downhole and the sleeve 302B can be subjected to a predetermined stimulus (i.e., transition temperature), the sleeve 302B will revert back to its initial set shape.

3. Roller Forming

Figure 33:
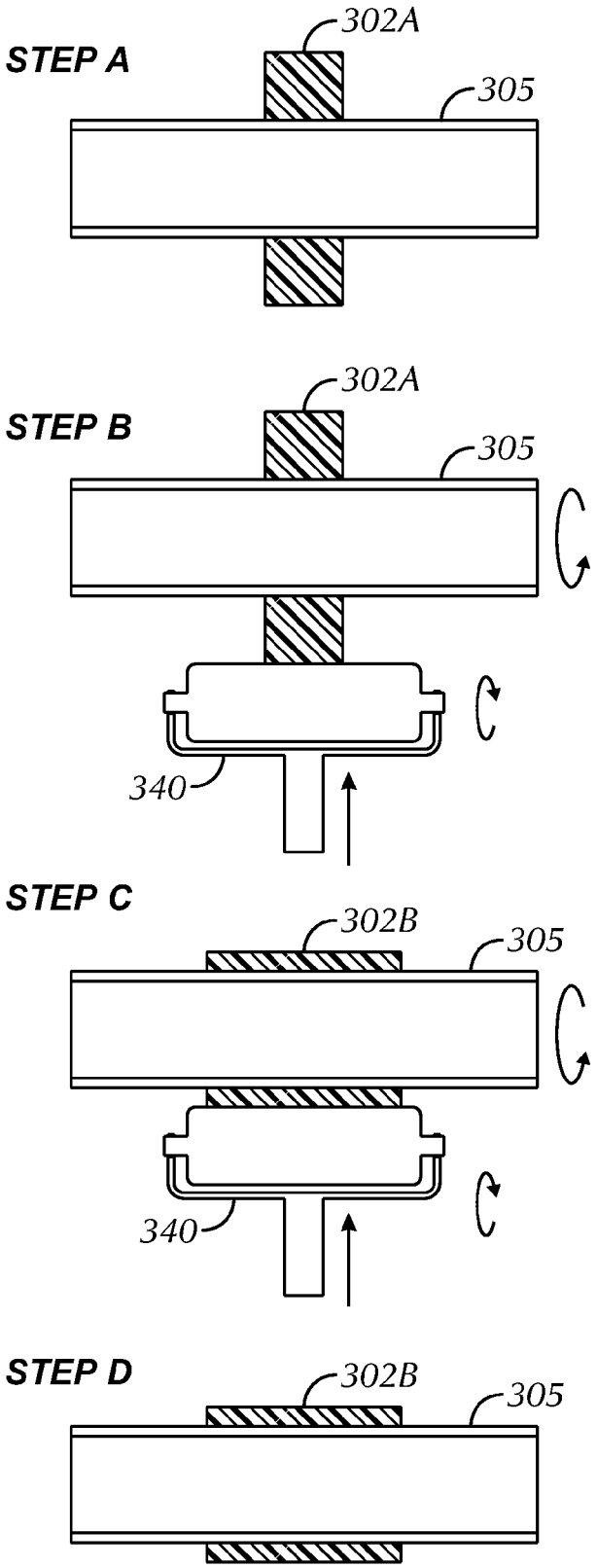
FIG. 33 shows a roller programming process for a packing element of a tool.

FIG. 33 shows a roller programming process for a packing element composed of an SMP material. As shown, a cylindrical sleeve made of SMP is programmed from an original larger diameter to a smaller final diameter by a roller forming process. In this process, the SMP material is molded into a cylindrical sleeve 302A, which can be a "set" shape for a packing element. The molded sleeve 302A positions on a mandrel 305 with the appropriate diameter for a given application (Step A).

The mandrel 305 places on a lathe or other rotary device (not shown) and is heated (Step B). While at a temperature above the transition temperature of the SMP material, a roller or series of rollers 340 compress and deform the SMP material of the sleeve 302A into a smaller run-in diameter as the mandrel 305 is rotated (Step C). Once a compressed sleeve 302B is formed at the desired smaller diameter, the heat source is removed allowing the SMP material of the sleeve 302B to cool and retain its new compressed shape. During compression, the rollers 340 can be move axially up and down the length of the sleeve to aid in staged compression. Also specific/custom profiles can be programmed in the SMP using this roller forming process. Ultimately, this mandrel 305 can be run downhole and the sleeve 302B can be subjected to a predetermined stimulus (i.e., transition temperature), the sleeve 302B will revert back to its initial set shape.

4. Extrusion Forming

Figure 34:
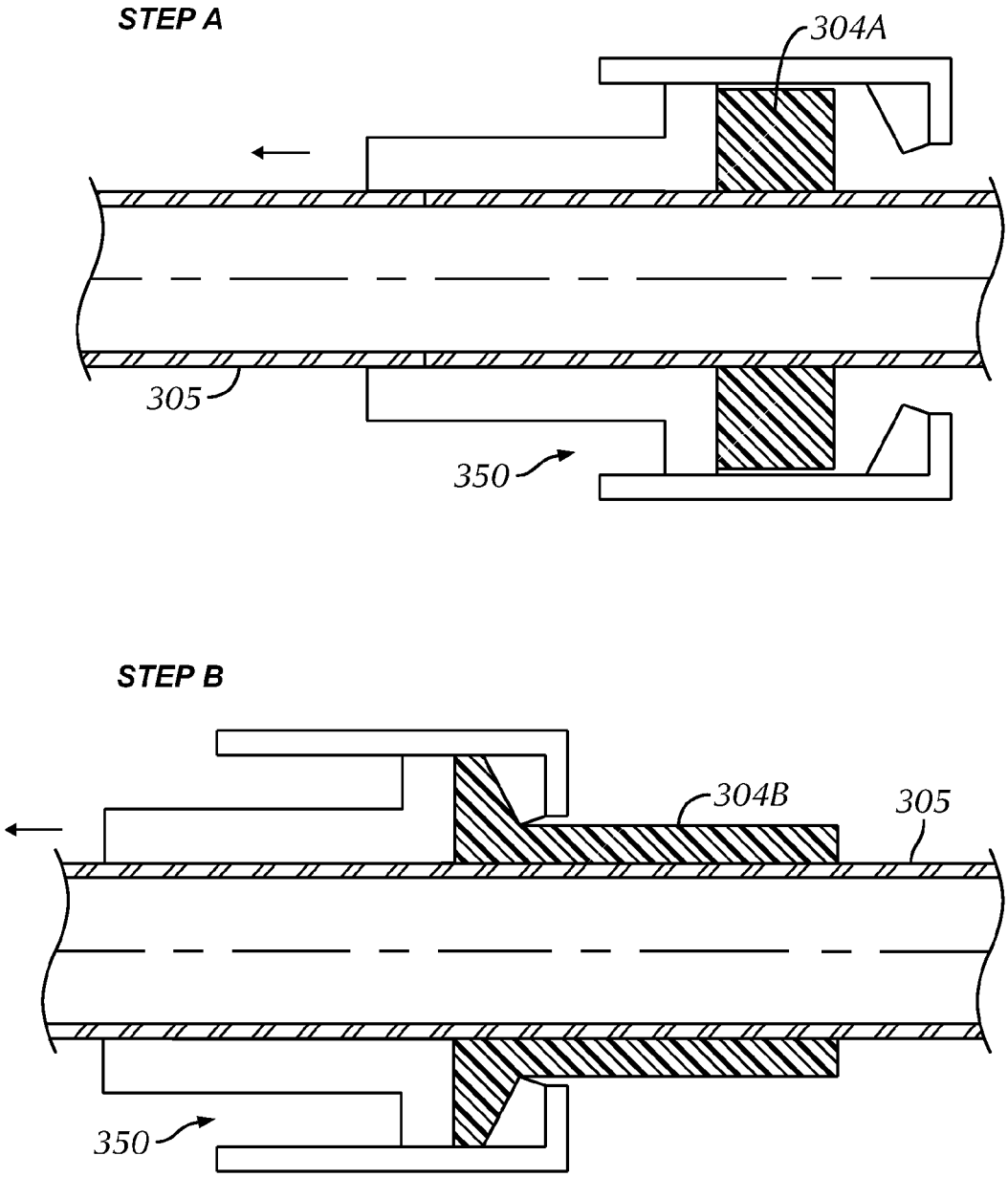
FIG. 34 shows an extrusion programming process for a packing element of a tool.

FIG. 34 shows an extrusion programming process for a packing element of a tool. As shown, a cylindrical sleeve 304A made of SMP is programmed from an original larger diameter to a smaller final diameter by an extrusion forming process. In this process, the SMP material is molded into a cylindrical sleeve 304A, which can be a "set" shape for a packing element. The molded sleeve 304A positions on a mandrel 305 with the appropriate diameter for a given application.

An extruder 350 positions on the mandrel 305 around the molded sleeve 304A (Step A). Once the extruder 350 is positioned, the assembly is heated to bring the SMP material of the sleeve 304A above its transition temperature. When this temperature is reached, the extruder 350 is pulled over the sleeve 304A along the mandrel 305 to reduce the sleeve's diameter and increase its length for a "run-in" shape of an extruded sleeve 304B (Step B). This process can be performed in stages until desired final diameter is achieved. Once formed, the assembly is removed from the heat source and cooled to allow the SMP material of the extruded sleeve 304B to retain its new shape. Ultimately, this mandrel 305 can be run downhole and the sleeve 304B can be subjected to a predetermined stimulus (i.e., transition temperature). In this case, the extruded sleeve 304B will revert back to its initial set shape (304A).

H. Flow Shut-off and Sliding Sleeve Applications Using SMP Material

The ability of SMP material to store potential energy allows the material to be used in applications to apply a force when activated. As such, the SMP material can be used similar to a spring to actuate devices in a downhole environment. As specifically shown in FIGS. 35A-35B and 36A-36B, a flow control device 400, such as a sliding sleeve or flow shut-off devices for downhole use, uses a shape memory polymer material for actuation.

Figure 35A:
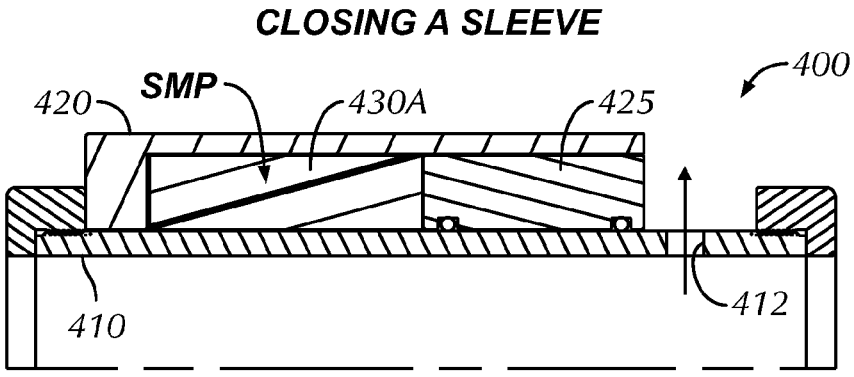
FIGS. 35A-35B show a flow control device for downhole use that has a shape memory polymer for actuation.
Figure 35B:
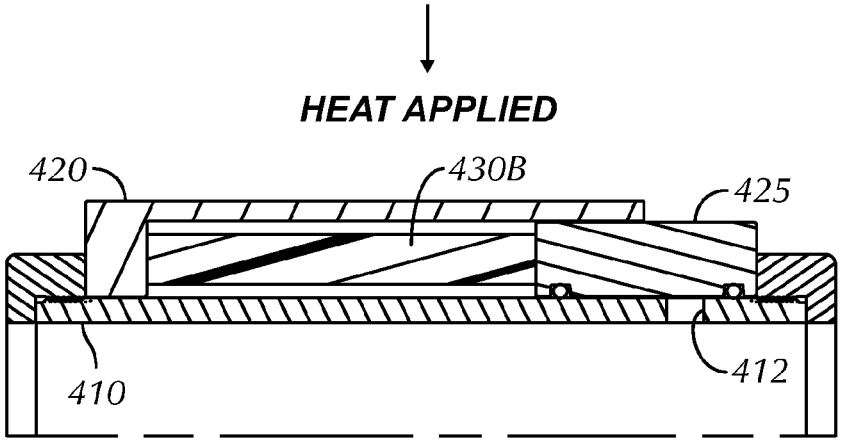

As shown in FIG. 35A, SMP material is initially manufactured into an elongated sleeve 430B. When this elongated sleeve 430B is heated above its transition temperature, a programming process then compresses it axially into a short compact sleeve 430A. This sleeve 430B may be physically attached to a sliding sleeve 420 through a bonding agent or mechanical means. The compacted sleeve 430A and sliding sleeve 425 position within a confined housing 420 on a downhole tool 400. As shown in FIG. 35B, the compacted sleeve 430A can then be actuated by heat or other stimulus such as described herein. As a result, the compacted sleeve 430A expands to its initial shape as an elongated sleeve 430B. This expansion pushes the sealing sleeve 425 along an inner mandrel 410 to shut-off flow through the mandrel's ports 412.

Figure 36A:
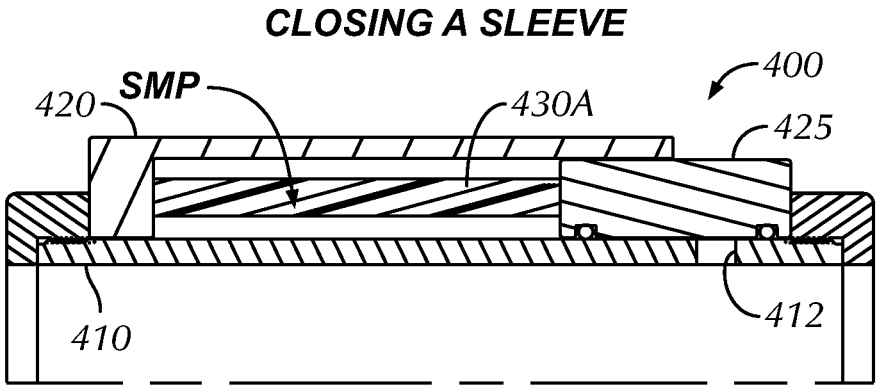
FIGS. 36A-36B show a flow control device for downhole use that has a shape memory polymer for actuation.
Figure 36B:
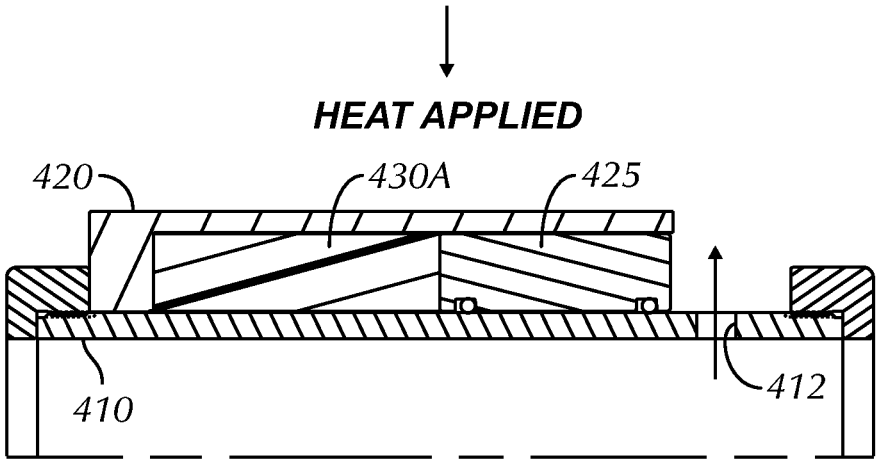

The same principle can be used in a reverse arrangement. As shown in FIG. 36A, SMP material is initially manufactured into a compact sleeve 430A. When this compact sleeve 430A is heated above its transition temperature, a programming process stretches this sleeve 430A axially into an elongated sleeve 430B. This sleeve 430B physically attaches to a sliding sleeve 420 through a bonding agent or mechanical means. The elongated sleeve 430B and sliding sleeve 425 position within a confined housing 420 on a downhole tool 400. As shown in FIG. 36B, the elongated sleeve 430B can then be actuated by heat or other stimulus such as described herein. As a result, the elongated sleeve 430B retracts to its initial compact shape. This retraction pulls the sealing sleeve 425 along the inner mandrel 410 to open flow through the mandrel's ports 412.

I. Multiple Material Seal System Using SMP as Booster.

A downhole tool, such as a packer or bridge plug, can use a stack of sealing elements made of various materials. SMP materials can be used with these sealing elements as a booster to increase both seal integrity and the ability to seal at larger temperature ranges.

Figure 37A:
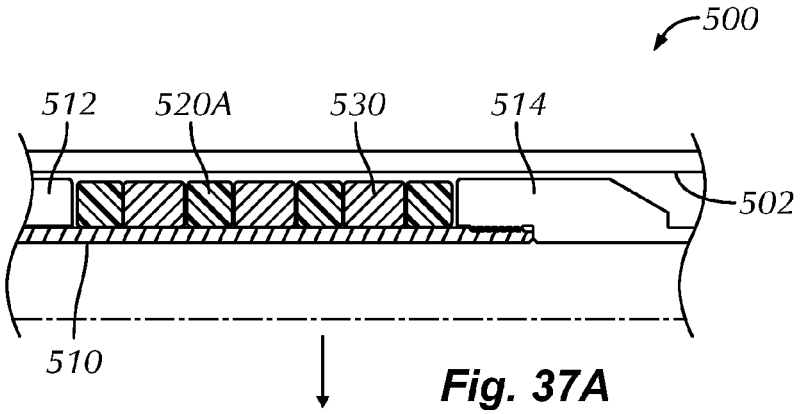
Figure 37B:
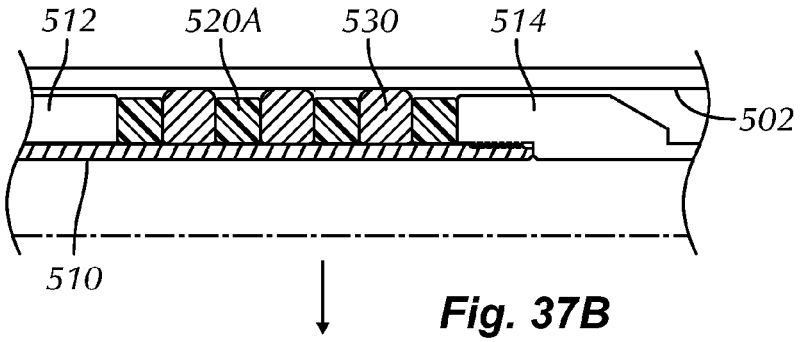
Figure 37C:
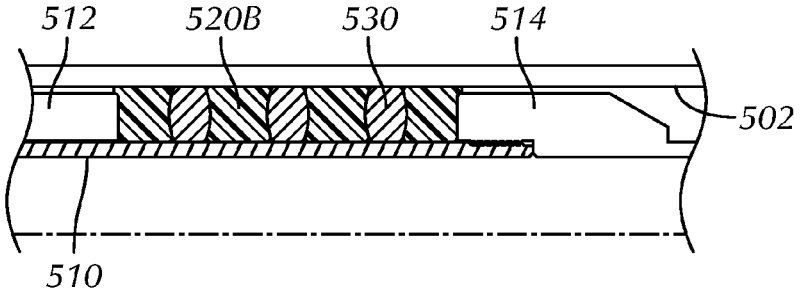

In FIGS. 37A-37C, for example, a seal array 500 positions on an inner mandrel 510 that runs into a tubular 502 downhole. The seal array 500 has primary seals 530 composed of elastomer, soft metal, or other material known in the art. The primary seals 530 are sandwiched between secondary seals 520 made of an SMP material. These secondary seals 520 have a compressed state (A) for run-in downhole and have an expanded state (B) when activated. Of course, the shapes, number, and geometry of the seals 520/530 may vary depending on the implementation.

As shown in FIG. 37A, the tool deploys downhole with the seal array arranged between shoulders 512/514. The secondary seals 520 are in their compressed state (A), and the primary seals 530 are uncompressed. Once positioned at a desired location in the tubular 502, force from a piston or other known mechanism forces one shoulder 512 towards the other 514 to compress the seal array 500. As shown in FIG. 37B, this force compresses the primary seals 530 to contact the surrounding tubular 502 and can create a seal capable of withstanding a certain pressure differential and temperature range.

At a later time, the seal array 500 is further activated as shown in FIG. 37C by application of a predetermined stimulus. Various techniques disclosed herein can be used to further activate the seal. For example, steam may be injected into the well to apply heat to the tool. Alternatively, any of the other stimulating techniques (e.g., electricity, magnetism, etc.) described herein can be used.

Either way, the SMP material of the secondary seals 520 reaches transition and expands to its original expanded state (B). This expansion applies further compressive forces to the primary seals 530 and boosts the resulting seal produced by the seal array 500. With the SMP seals activated, the seal array 500 has increased integrity capable of withstanding higher differential pressures and larger temperature ranges.

Figure 38A:
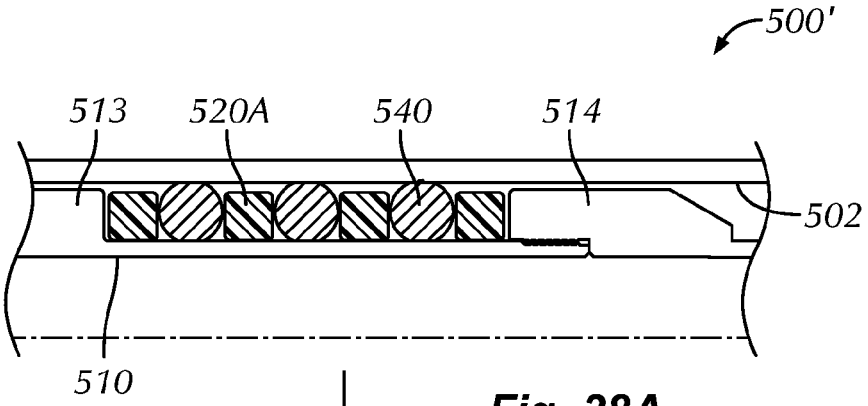
FIGS. 38A-38B shows another seal array using seals composed of SMP material on a tool.
Figure 38B:
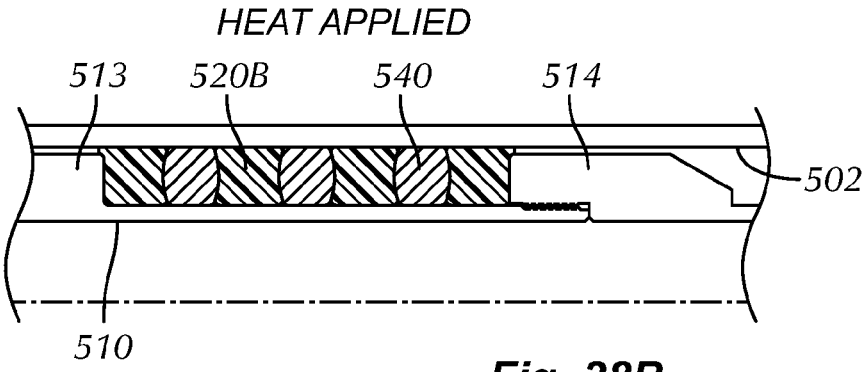

In FIGS. 38A-38B, another seal array 500' positions on an inner mandrel 510 that runs into a tubular 502 downhole. As shown in FIG. 38A, this seal array 500' is similar to a chevron stack or seal stack that can be stabbed into a seal bore or tubular 502. When fit into the tubular 502, for example, the primary seals 530 are pre-squeezed and engage the tubular 502. Then, as shown in FIG. 38B, with the application of a predetermined stimulus (e.g., heat above the transition temperature), the secondary seals 520 of SMP material can be activated from their compressed state (A) to expanded state (B). This activation thereby boosts the resulting seal produced with the seal array 500'.

J. Material Selection

Various types of shape memory polymers (SMP) are known in the art. These SMP materials include both shape memory elastomers and shape memory thermoplastics. One of these types of SMP materials may have benefits over another for a given implementation. For example, in FIGS. 5A-5B, an SMP material can be "coated" to overcome chemical incompatibilities. The coating can be a shape memory thermoplastic over a standard elastomer or over a shape memory elastomer (SME).

For downhole use, the transition temperature or other stimulus associated with the shape memory polymer should be outside the standard operating conditions that exist downhole. For example, the transition temperature for any of the various SMP materials used for the packing elements disclosed herein may be about 200° C. and higher. Although the particular SMP material used will depend on the implementation and intended application, some examples of suitable SMP materials for use downhole in the elements of the present disclosure include those shape memory polymers based on copolymers having polyamides (e.g., Nylon-6 and Nylon-12), polynoroborene, polyethelyne/Nylon-6 graft copolymer, and poly (ϵ-caprolactone). Any chemical incompatibility of the selected SMP material could be overcome in some situations using an appropriate coating. Various SMP materials are available in the art and can be used for the disclosed packer concepts. Characteristics of some SMP materials are described in A. Lindlein, S. Kelch, "Shape-Memory Polymers," Angew. Chem. Int. Ed. 2002, 41, 2034-2057, which is incorporated herein by reference.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

The invention claimed is:

1. A downhole tool, comprising:

a mandrel;

an inflatable element disposed on the mandrel, the inflatable element defining a first chamber and being inflatable with a fluid introduced in the first chamber to an inflated state to engage a surrounding sidewall; and at least a portion of the inflatable element being composed of a shape memory polymer and activating from a first state to a second state in response to a predetermined stimulus, the portion in the second state at least partially expanding the inflatable element.

2. The tool of claim 1, further comprising an activator activating the portion of the inflatable element from the first state to the second state with the predetermined stimulus.

3. The tool of claim 2, wherein the activator comprises a power source electrically coupled to a heating element disposed relative to the portion of the inflatable element, the heating element operable to produce heat as the predetermined stimulus.

4. The tool of claim 2, wherein the activator comprises a power source electrically coupled to an electromagnet disposed relative to the portion of the inflatable element, the electromagnet operable to produce an electromagnetic field as the predetermined stimulus.

5. The tool of claim 2, wherein the activator comprises a power source electrically coupled to the portion of the inflatable element, the power source operable to produce an electrical current as the predetermined stimulus.

6. The tool of claim 2, wherein the activator comprises a power source electrically coupled to a light source disposed relative to the portion of the inflatable element, the light source operable to produce electromagnetic radiation as the predetermined stimulus.

7. The tool of claim 2, wherein the activator comprises a second chamber disposed relative to the portion of the inflatable element, the second chamber containing a chemical releasable from the second chamber and operable to produce a chemical reaction as the predetermined stimulus.

8. The tool of claim 2, wherein the activator comprises a power source electrically coupled to an ultrasonic source disposed relative to the portion of the inflatable element, the ultrasonic source operable to produce an ultrasonic signal as the predetermined stimulus.

9. The tool of claim 1, further comprising a deployment tool connecting to the downhole tool and having an inflator, the inflator introducing the fluid into the first chamber and inflating the inflatable element to the inflated state.

10. The tool of claim 9, wherein the deployment tool comprises an activator activating the portion from the first state to the second state with the predetermined stimulus.

11. The tool of claim 10, wherein the activator comprises an electrical source, a magnetic source, a chemical source, an electromagnetic source, an ultrasound source, or a radioactive source.

12. The tool of claim 1, wherein the tool comprises a packer.

13. The tool of claim 1, wherein the tool comprises a bridge plug.

14. The tool of claims 1, wherein the first state of the shape memory polymer is programmed by one or more of pressure, heat, folding, hydroforming, vacuum forming, clamp-die forming, and extrusion forming.

15. The tool of claim 1, wherein the predetermined stimulus is selected from the group consisting of an application of light, magnetic field, heat, ultrasound, fluid, chemical stimulant, exothermic reaction, change in pH, radiation, and electricity.

16. The tool of claim 1, wherein the inflatable element comprises a bladder defining the first chamber and being inflatable with the fluid introduced in the first chamber to the inflated state to engage the surrounding sidewall. element in the second state expands the bladder of the inflatable element from an initial state situated close to the mandrel to a preloaded state situated away from the mandrel.

17. The tool of claim 16, wherein the portion of the inflatable element in the second state expands the bladder of the inflatable element from an initial state situated close to the mandrel to a preloaded state situated away from the mandrel.

18. The tool of claim 17, further comprising an inflator inflating the bladder from the preloaded state to the inflated state.

19. The tool of claim 16, wherein the bladder is at least partially composed of the shape memory polymer.

20. The tool of claim 16, and wherein the portion of the inflatable element composed of the shape memory polymer comprises a stent associated with the bladder.

21. The tool of claim 20, wherein the stent disposes internally to the bladder, externally to the bladder, or is incorporated into material of the bladder.

22. The tool of claim 20, wherein the stent comprise a plurality of slats disposed longitudinally relative to the bladder.

23. The tool of claim 20, wherein the stent comprise a spring wound about a length of the bladder.

24. The tool of claim 20, wherein the stent comprises a plurality of slats interwoven with one another.

25. A downhole tool, comprising:

a mandrel;

a gage ring disposed on the mandrel;

a packing element disposed on the mandrel adjacent the gage ring, the packing element composed of an elastomeric material compressible by movement of the gage ring; and an activatable element composed of a shape memory polymer and associated with the packing element, the activatable element activating from a first state to a second state in response to a predetermined stimulus, the first state allowing the tool to run downhole, the second state blocking extrusion of the elastomeric material of the packing element into a gap between the gage ring and a surrounding sidewall.

26. The tool of claim 25, wherein the activatable element is at least a portion of the packing element, is disposed on the mandrel between the packing element and the gage ring, is disposed on the gage ring, or is at least a portion of the gage ring.

27. A downhole tool, comprising:

a mandrel; and at least one packing element disposed on the mandrel and composed of a shape memory polymer, the at least one packing element activated from a first state to a second state by a first predetermined stimulus, the at least one packing element in the first state situating close to the mandrel, the at least one packing element in the second state distended away from the mandrel to engage a surrounding sidewall, the at least one packing element activated from the second state to a third state by a second predetermined stimulus, the at least one packing element in the third state situating close to the mandrel.

28. The tool of claim 27, wherein the at least one packing element comprises a cup packer disposed on the mandrel, the first state being the cup packer closed close to the mandrel, the second state being the cup packer opened away from the mandrel.

29. The tool of claim 28, wherein the at least one packing element comprises a plurality of the cup packers.

30. The tool of claim 27, wherein the at least one packing element comprises a circumferential sleeve disposed about the mandrel.

31. A downhole tool, comprising:

a mandrel; and at least one packing element disposed on the mandrel and composed of a shape memory polymer, the at least one packing element activated from a first state to a second state by a first predetermined stimulus, the at least one packing element in the first state situated close to the mandrel, the at least one packing element in the second state distended away from the mandrel to engage a surrounding sidewall, wherein the mandrel comprises a shape memory alloy having an initial state and an activated state, the mandrel in the initial state having a smaller diameter than the activated state, the mandrel activated from the initial state to the second state by a second predetermined stimulus.

32. The tool of claim 31, wherein the mandrel has a greater length in the initial state than in the activated state.

33. The tool of claim 31, wherein the second predetermined stimulus includes application of heat above a transition point.

* * * * *